US010520270B2

(12) United States Patent
Bair

(10) Patent No.: US 10,520,270 B2
(45) Date of Patent: Dec. 31, 2019

(54) SEMI-AUTOMATIC FIREARM RAPID-FIRE ACCESSORY

(71) Applicant: Dennis Michael Bair, Reston, VA (US)

(72) Inventor: Dennis Michael Bair, Reston, VA (US)

( * ) Notice: Subject to any disclaimer, the term of this patent is extended or adjusted under 35 U.S.C. 154(b) by 0 days.

(21) Appl. No.: 15/967,264

(22) Filed: Apr. 30, 2018

(65) Prior Publication Data

US 2018/0347930 A1 Dec. 6, 2018

Related U.S. Application Data

(60) Provisional application No. 62/492,924, filed on May 1, 2017.

(51) Int. Cl.
*F41A 19/09* (2006.01)

(52) U.S. Cl.
CPC ..... *F41A 19/09* (2013.01)

(58) Field of Classification Search
CPC ..... F41A 19/09
USPC ..... 89/136
See application file for complete search history.

(56) References Cited

U.S. PATENT DOCUMENTS 1,307,594 A * 6/1919 Newman ..... F41A 1/04 89/1.1
2,943,412 A * 7/1960 McNally ..... F41A 19/09 42/69.03
3,091,878 A * 6/1963 Savioli ..... F41A 19/09 42/69.01
4,276,808 A * 7/1981 York ..... F41A 19/09 89/136
4,532,852 A * 8/1985 Hance ..... F41A 19/09 89/136
4,553,347 A * 11/1985 Jackson ..... F41A 19/09 42/69.01
4,685,379 A * 8/1987 Troncoso ..... F41A 19/09 42/69.01
4,787,288 A * 11/1988 Miller ..... F41A 19/02 89/136
4,803,910 A * 2/1989 Troncoso ..... F41A 19/09 89/129.02
5,780,762 A * 7/1998 Kobayashi ..... F41A 19/33 89/136

(Continued)

*Primary Examiner* — Joshua E Freeman
*Assistant Examiner* — Bridget A Cochran
(74) *Attorney, Agent, or Firm* — The Marbury Law Group, PLLC

(57) ABSTRACT

Devices, systems, and methods of manufacturing are disclosed with regard to a rapid-fire accessory for a semi-automatic firearm. The rapid-fire accessory may include a trigger guard mount, a trigger actuator, and a trigger guard adapter. The trigger guard mount may include a mounting channel for receiving a trigger guard. The trigger actuator may be fixed relative to the mounting channel and configured to pull the trigger when the trigger guard slides forward in the mounting channel. The trigger guard adapter may be configured to mount on and remain fixed relative to the trigger guard. The trigger guard adapter may include an adapter channel for receiving the trigger guard. When the trigger guard adapter is mounted on the trigger guard and in the mounting channel, the trigger guard adapter guides a sliding movement of the trigger guard mount forward and rearward relative to the trigger guard adapter and the trigger guard.

5 Claims, 17 Drawing Sheets

(56) References Cited

U.S. PATENT DOCUMENTS

| | | | | |
|---|---|---|---|---|
| 6,101,918 | A * | 8/2000 | Akins | F41A 19/03 89/129.01 |
| 6,223,644 | B1 * | 5/2001 | Troncoso | F41A 19/09 42/69.01 |
| 6,336,283 | B1 * | 1/2002 | Ortiz | F41A 17/02 42/69.01 |
| 7,103,999 | B2 * | 9/2006 | Jones | F41A 19/09 42/69.01 |
| 7,273,002 | B1 * | 9/2007 | Rogers | F41A 19/09 89/142 |
| 8,127,658 | B1 * | 3/2012 | Cottle | F41A 19/11 42/69.01 |
| 8,176,835 | B1 * | 5/2012 | Cottle | F41A 19/11 42/69.01 |
| 8,474,169 | B2 * | 7/2013 | Cottle | F41C 23/04 42/73 |
| 9,605,925 | B1 * | 3/2017 | McRoberts | F41C 23/10 |
| 2012/0186122 | A1 * | 7/2012 | Zamlinsky | F41A 19/10 42/69.01 |
| 2014/0007763 | A1 * | 1/2014 | Foster | F41A 19/03 89/136 |
| 2014/0075803 | A1 * | 3/2014 | Muller | F41A 11/02 42/16 |
| 2015/0184967 | A1 * | 7/2015 | Whittington | F41A 19/09 42/69.01 |
| 2015/0241154 | A1 * | 8/2015 | Istvanovics | F41C 23/12 89/140 |
| 2015/0267992 | A1 * | 9/2015 | Alderman | F41A 19/59 42/90 |
| 2017/0350668 | A1 * | 12/2017 | Angelis-Johns | F41A 19/10 |

* cited by examiner

SEMI-AUTOMATIC FIREARM RAPID-FIRE ACCESSORY

CROSS-REFERENCE TO RELATED PATENT APPLICATIONS

This patent application claims the benefit of and priority to U.S. Provisional Patent Application No. 62/492,924 filed on May 1, 2017, the entire contents of which are hereby incorporated by reference.

BACKGROUND

Various techniques and devices increase the firing rate of a semi-automatic firearm. Bump firing is a technique of firing a semi-automatic firearm using the recoil energy from firing the weapon to rapid-fire faster than what an operator could achieve by repeated finger pulls.

Operators may bump fire a semi-automatic firearm without the use of tools, accessories, or alterations to the weapon, but such freehand techniques are difficult to master. To execute a freehand technique, the operator generally holds the semi-automatic firearm away from his or her body in order to allow the weapon to recoil after firing. One freehand technique has the operator hold a trigger hand in a rigid position with a trigger finger just in front of the trigger while placing a forend hand (i.e., the other hand) on a hand guard of the weapon. The hand guard generally covers the barrel of the semi-automatic firearm, which is forward of the trigger. Using the forend hand to push the hand guard forward, while maintaining the trigger hand in the rigid position, the semi-automatic firearm shifts forward relative to the trigger hand. This forward movement causes the trigger to engage the trigger finger, which if held firmly in the rigid position will discharge the semi-automatic firearm. Recoil from the discharge of a bullet pushes the semi-automatic firearm rearwards away from the trigger finger, allowing the trigger to re-set. If the operator maintains a forward force on the hand guard while keeping the trigger hand stationary in the rigid position (i.e., pulling the forend hand away from the trigger hand), the operator will be able to once again push the hand guard forward after the recoil energy dissipates, which once again discharges the weapon. By continuously maintaining the forward force on the hand guard with the trigger hand in the rigid position, the weapon will discharge in a rapid-fire succession that is generally faster than what the operator can achieve with repeated finger pulls. Not all operators that attempt this technique are successful or consistently successful.

SUMMARY

Devices, systems, and methods of various embodiments are disclosed including a rapid-fire accessory for a semi-automatic firearm. The rapid-fire accessory may include a trigger guard mount and a trigger actuator. The trigger guard mount may attach the rapid-fire accessory to the semi-automatic firearm. The trigger guard mount may include a mounting channel for receiving a trigger guard of the semi-automatic firearm. When mounted in the mounting channel, the trigger guard guides a sliding movement of the trigger guard mount forward and rearward relative to the trigger guard. The trigger actuator may engage a trigger of the semi-automatic firearm. The trigger actuator may be fixed relative to the mounting channel and configured to pull the trigger when the trigger guard slides forward in the mounting channel.

Various embodiments include a receiving aperture in the mounting channel on a lateral side of the mounting channel for inserting the trigger guard into the mounting channel. A detent may protrude across a portion of the receiving aperture for trapping the trigger guard in the mounting channel. The mounting channel may be formed by an upper wall, a lower wall opposed to the upper wall, and a lateral wall connecting the lower wall and the upper wall. The trigger guard may be in sliding engagement with at least one of the lower wall and the upper wall during the sliding movement. When the trigger guard is mounted in the mounting channel, the upper wall may be disposed between the trigger and the trigger guard. The mounting channel may include a receiving aperture for inserting the trigger guard in the mounting channel. Flexing a portion of the trigger guard mount may increase a width of the receiving aperture for releasing the trigger guard from the mounting channel. The trigger actuator may be formed by a wall of a trigger recess in the trigger guard mount. The mounting channel may be formed by a left wall, a right wall opposed to the left wall, and a lower wall connecting the left wall and the right wall. The trigger guard may be in sliding engagement with the lower wall during the sliding movement. The trigger guard may be disposed between the trigger actuator and the lower wall when the trigger guard is mounted in the mounting channel. The trigger actuator may be removably secured to at least one of the left wall and the right wall, wherein removal of the trigger actuator releases the trigger guard from the mounting channel. The trigger guard may extend across the mounting channel from a left wall to a right wall opposed to the left wall. The trigger actuator may be a removably secured element. The mounting channel may extend between a trigger finger grip and an opposed thumb grip.

Various embodiments include a trigger finger grip that may extend from a lateral side of an upper portion of the trigger guard mount. The trigger finger grip may be configured to engage a trigger finger while the trigger actuator is engaged on the trigger. An extension member may extend from a lateral side of the trigger guard mount rearward away from the trigger actuator. A lower finger grip may protrude from a lower portion of the trigger guard mount. The lower finger grip may be configured to engage a finger of an operator while the operator is firing the semi-automatic firearm. A thumb grip may be disposed remote from the trigger guard mount and configured to engage a thumb of an operator while the operator is firing the semi-automatic firearm. A trigger finger grip may be disposed forward of the trigger actuator. The trigger finger grip may be configured to engage a trigger hand finger of an operator while the operator is firing the semi-automatic firearm. A thumb grip may be disposed rearward from the trigger actuator. The thumb grip may be configured to engage an operator's thumb while an operator is firing the semi-automatic firearm.

Various embodiments include a method of mounting a rapid-fire accessory on a trigger guard of a semi-automatic firearm. The method may include mounting a trigger guard mount of the rapid-fire accessory onto the trigger guard. Once mounted on the semi-automatic firearm, the trigger guard may be disposed in a mounting channel of the trigger guard mount. The trigger guard may guide a sliding movement of the trigger guard mount forward and rearward relative to the trigger guard. The rapid-fire accessory may include a trigger actuator for engaging a trigger of the semi-automatic firearm, wherein the trigger actuator is fixed relative to the mounting channel and configured to pull the trigger when the trigger guard slides forward in the mounting channel.

Various embodiments include moving a detent protruding across a portion of the receiving aperture from an initial position to enable the trigger guard to be inserted in the mounting channel. Returning the detent to the initial position may trap the trigger guard in the mounting channel.

BRIEF DESCRIPTION OF THE DRAWINGS

The accompanying drawings, which are incorporated herein and constitute part of this specification, illustrate example embodiments of the invention, and together with the general description given above and the detailed description given below, serve to explain the features of the invention.

DETAILED DESCRIPTION

Figure 1A:
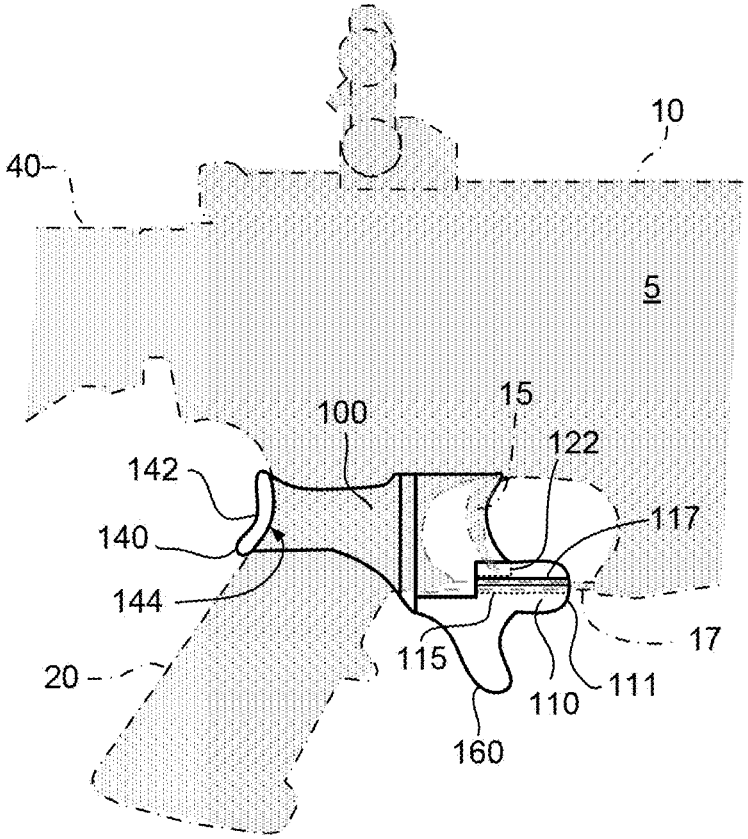
FIG. 1A illustrates a right side view of a rapid-fire accessory on a semi-automatic firearm, shown in phantom, in a ready-to-fire configuration in accordance with various embodiments.

Various embodiments will be described in detail with reference to the accompanying drawings. Wherever possible the same reference numbers will be used throughout the drawings to refer to the same or like parts. References made to particular examples and implementations are for illustrative purposes, and are not intended to limit the scope of the invention or the claims.

Various embodiments include a rapid-fire accessory that mounts onto the trigger guard of a semi-automatic firearm. The rapid-fire accessory does not require the removal or replacement of the original, replacement, or aftermarket firearm grip or other components of the firearm. The rapid-fire accessory provides a structural component an operator may hold that facilitates bump firing the semi-automatic firearm. Once mounted on the semi-automatic firearm, the rapid-fire accessory may slide forward and rearward, using a trigger guard of the semi-automatic firearm as a guiding surface. The rapid-fire accessory also includes finger grips for comfortably and securely holding both the rapid-fire accessory as well as the semi-automatic firearm to assist an operator in bump firing the firearm rapidly utilizing the recoil energy of the firearm.

The term "semi-automatic firearm" as used herein refers generally to a portable gun that is configured to self-load by performing all the steps necessary to prepare the weapon to discharge again after firing. A semi-automatic firearm comprises a barreled weapon that launches a series of bullets driven by the action of an explosive force such as gunpowder. A semi-automatic firearm may include any one or all of rifles, shotguns, carbines, and even long-barrel handguns that include a hand guard on the barrel and are suitable for bump firing. Semi-automatic firearms include a receiver into which a cartridge is loaded that holds each bullet until it is fired. In addition, semi-automatic firearms include a barrel, extending from the receiver, and a trigger assembly for firing the weapon. The barrel and/or the receiver may be mounted in or integrally formed into a stock made of wood, plastic, metal, composite, or any combination thereof. Semi-automatic firearms generally include various grip surfaces such as the hand guard on the barrel, a butt stock to place against an operator's shoulder, and/or an intermediate grip surface.

The term "trigger" as used herein refers generally to a lever or button mechanism that actuates the firing sequence of a semi-automatic firearm. A trigger may directly or indirectly cause the release of powerful energy (i.e., an explosion) that propels a bullet from the weapon. Triggers are generally configured to be actuated by an index finger, which may also be referred to as the trigger finger, although other fingers may be used. The term "trigger guard" as used herein refers to a structural element that is part of the semi-automatic firearm, such as an original, replacement, or aftermarket part thereof. The trigger guard blocks direct engagement of the trigger from at least below the semi-automatic firearm, which generally requires an operator to approach the trigger with a trigger finger from one of the lateral sides.

The term "operator" as used herein refers generally to a person who uses and controls the semi-automatic firearms. An operator generally uses two hands to bump fire a semi-automatic firearm. One hand, used to hold part of the semi-automatic firearm near the trigger, is referred to herein as the "trigger hand." Generally, an index finger is used as a trigger finger, however any finger on the trigger hand used to pull the trigger may be referred to as the "trigger finger." Other fingers on the trigger hand not typically used to pull the trigger may be referred to individually as trigger-hand fingers, such as the trigger-hand thumb or the trigger-hand middle finger. The other hand (i.e., the non-trigger hand), may be used to hold a forend of the semi-automatic firearm by way of the hand guard, and is referred to herein as the "forend hand."

In various embodiments, the rapid-fire accessory is illustrated and described with an asymmetric design suitable for a right-handed or left-handed operator. It should be understood that various embodiments may be modified to invert the structures when forming a rapid-fire accessory to accommodate a left-handed operator. In this way, the left side becomes the right side and vise-versa.

Figure 1B:
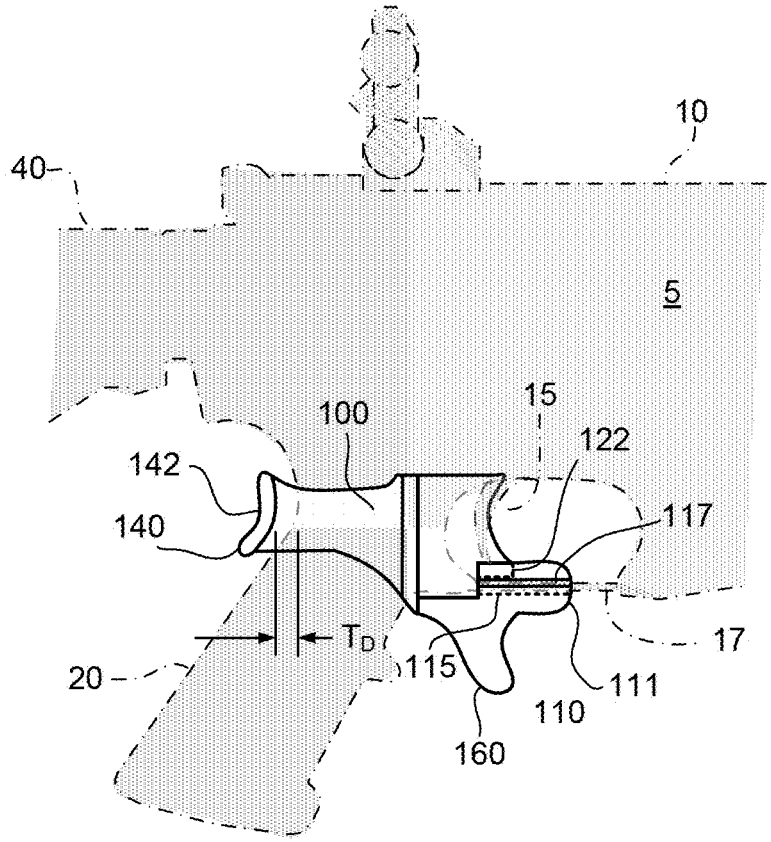
FIG. 1B illustrates a right side view of the rapid-fire accessory on the semi-automatic firearm of FIG. 1A in a fired configuration in accordance with various embodiments.

FIGS. 1A-1B illustrate a rapid-fire accessory 100 in accordance with various embodiments. In FIGS. 1A-1B, a semi-automatic firearm 5 and parts thereof (illustrated in phantom lines with gray fill) are shown in ready-to-fire and fired configurations, respectively, with the rapid-fire accessory 100 mounted thereon. In the orientations illustrated in FIGS. 1A-1B, the semi-automatic firearm 5 is aiming to the right, which is referred to herein as a "forward" direction, which is opposed to a "rearward" direction aiming to the left. Various features of the semi-automatic firearm 5 are also illustrated in silhouette including a receiver 10, a trigger 15, a trigger guard 17, a pistol grip 20, and a stock 40.

In various embodiments, the rapid-fire accessory 100 includes a trigger guard mount 110 for attaching the rapid-fire accessory 100 to the semi-automatic firearm 5. In some embodiments, the trigger guard mount 110 is a forward portion of the rapid-fire accessory 100 and may include a leading edge 111 of the rapid-fire accessory 100. An operator may secure the rapid-fire accessory 100 to the semi-automatic firearm 5 by snapping the trigger guard mount 110 onto the trigger guard 17 from a lateral side of the semi-automatic firearm 5. The trigger guard mount 110 includes a mounting channel 115 for receiving the trigger guard 17 of the semi-automatic firearm 5. A lateral side of the trigger guard mount 110 may be open, formed with a receiving aperture 117 through which the trigger guard 17 may be inserted into the mounting channel 115.

In FIG. 1A, the semi-automatic firearm 5 is in a ready-to-fire configuration with the trigger 15 of the semi-automatic firearm 5 in a forward position. From the ready-to-fire configuration, pulling the trigger 15 (i.e., pivoting or moving the trigger 15 rearward—toward the left as illustrated) will discharge the semi-automatic firearm 5. In contrast in FIG.

1B, the semi-automatic firearm 5 is in a fired configuration with the trigger 15 in a rearward position. From the loaded configuration (e.g., FIG. 1A), an operator generally holds the rapid-fire accessory 100 in a relatively fixed position while pushing the semi-automatic firearm 5 forward into the fired configuration (e.g., FIG. 1B), which discharges the semi-automatic firearm 5. The operator may hold the rapid-fire accessory 100 by placing one trigger-hand finger, such as a trigger-hand middle finger, on a forward side of a lower finger grip 160 while wrapping a trigger-hand thumb around a rear side of a thumb grip 140 onto a thumb engagement surface 142. The trigger guard 17, when mounted in the mounting channel 115, guides a sliding movement of the trigger guard mount 110, and the overall rapid-fire accessory 100, forward and rearward relative to the semi-automatic firearm 5. At the same time, the trigger guard 17 and the overall semi-automatic firearm 5, slide rearward and forward relative to the rapid-fire accessory. The semi-automatic firearm 5 shifts a distance TD between the ready-to-fire configuration and the fired configuration, which corresponds to how far the trigger 15 is pulled after being reset for discharging the semi-automatic firearm 5.

The rapid-fire accessory 100 also includes a trigger actuator 122 for engaging the trigger 15 of the semi-automatic firearm 5. Fixed relative to the mounting channel 115, the trigger actuator 122 is configured to pull the trigger 15 when the trigger guard 17 slides forward in the mounting channel 115. In various embodiments, the trigger actuator 122 may form a forward wall of the trigger recess 120. As illustrated in FIG. 4D, a lower tip of the trigger 15 may be disposed in the trigger recess 120. The trigger guard 17 sliding forward in the mounting channel 215 also means the semi-automatic firearm 5 is sliding forward relative to the rapid-fire accessory 100. This sliding movement causes the trigger actuator 122 to engage the lower tip of the trigger 15, pulling the trigger 15 rearward, which discharges the semi-automatic firearm 5. Alternatively, the trigger actuator 122 may include an adjustable set-type screw for adjusting a rearward/forward position of the trigger actuator 122. Adjustment of the rearward/forward position of the trigger actuator may be used to shorten or lengthen the distance TD between the ready-to-fire configuration and the fired configuration.

With the operator continuing to hold the rapid-fire accessory 100 in a relatively fixed position, the discharge of the semi-automatic firearm 5 causes a recoil force that slides the semi-automatic firearm 5 rearward relative to the rapid-fire accessory 100, which returns the semi-automatic firearm 5 to the ready-to-fire configuration (e.g., FIG. 1A). A forward edge 144 of the thumb grip 140 may act as a stop. Once the semi-automatic firearm 5 returns to the ready-to-fire configuration, if the operator maintains a steady forward-pushing force on the semi-automatic firearm 5 relative to the rapid-fire accessory 100, the semi-automatic firearm 5 will discharge in a rapid-fire succession like that of freehand bump fire techniques. However, unlike freehand bump fire techniques, use of the rapid-fire accessory 100 is easier to operate and does not involve elaborate and/or expensive accessories.

Figure 2A:
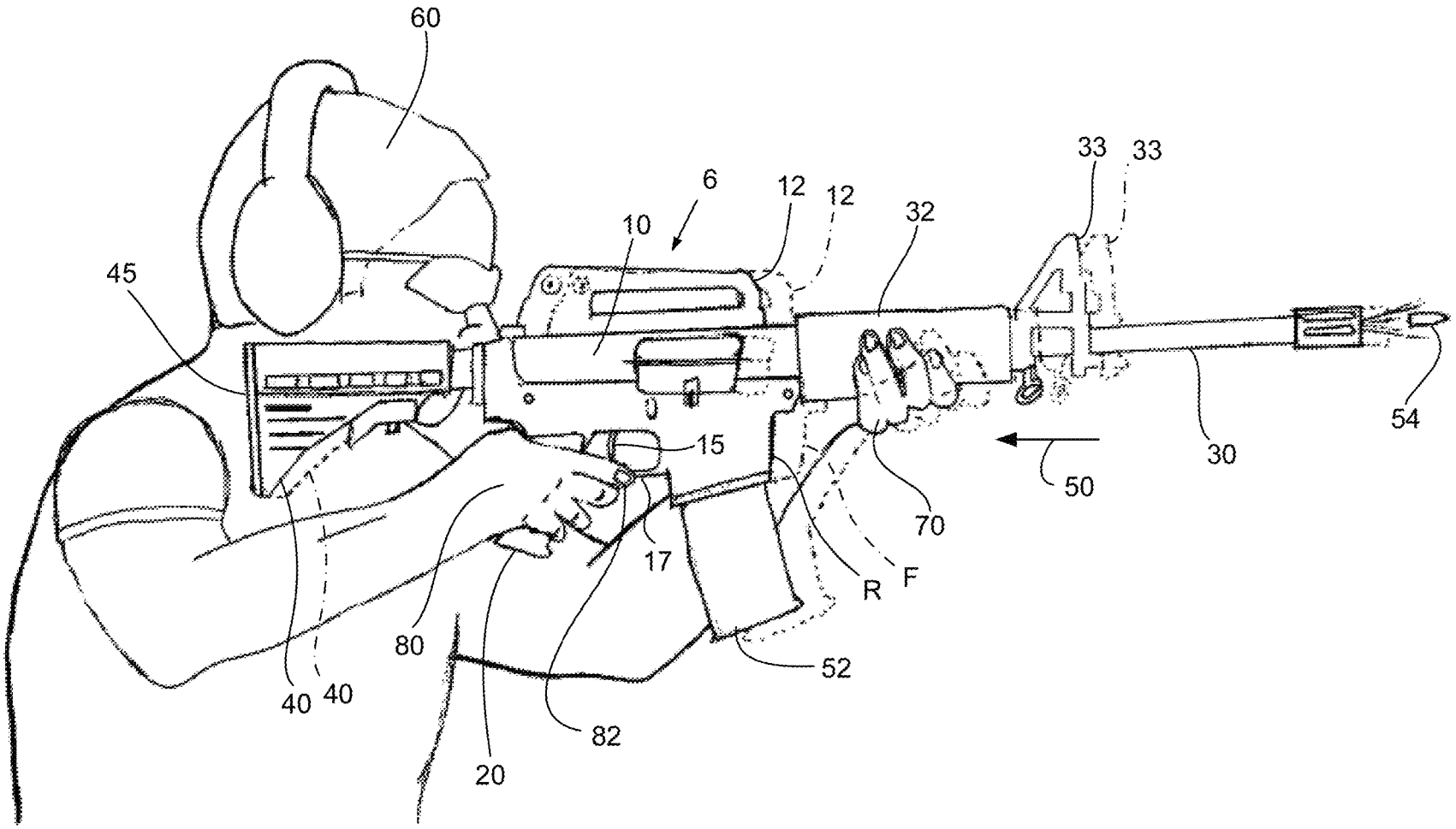
FIG. 2A illustrates a right side view of an operator firing a semi-automatic firearm using a rapid-fire accessory in accordance with various embodiments.

FIG. 2A illustrates an operator 60 firing a bullet 54 from another semi-automatic firearm 6 while using the rapid-fire accessory (e.g., 100, which is covered by a trigger hand 80 of the operator in FIG. 2A), in accordance with various embodiments. The semi-automatic firearm 6 is illustrated with solid lines representing a rearward position in the ready-to-fire configuration R and with dotted lines representing a forward position in the fired configuration F. The semi-automatic firearm 6 illustrated is an AR-15 style weapon, which includes a receiver 10, a trigger 15 with a trigger guard 17, a pistol grip 20, a barrel 30 with a hand guard 32, a stock 40 with a butt end 45, and a magazine 52 for holding ammunition (i.e., additional cartridges). Other features common to an AR-15 style weapon as well as other semi-automatic firearms are illustrated, including a carrying handle 12 and a front site 33.

The rapid-fire accessory in accordance with various embodiments may assist the operator 60 in bump firing the semi-automatic firearm 6. After mounting the rapid-fire accessory on the semi-automatic firearm 6, the operator 60 may hold the semi-automatic firearm 6 away from his or her body in order to allow the weapon to recoil rearward after firing. As shown, the butt end 45 is spaced away from the operator's shoulder. Alternatively, the semi-automatic firearm 6 could be held in other positions away from the operator's body, such as down near the hip. The operator 60 places a trigger hand 80 around both the rapid-fire accessory and the pistol grip 20. Unlike freehand bump fire techniques, the operator 60 does not need to work at maintaining the trigger hand 80 in a rigid position with a trigger finger 82 in front of the trigger 15. The rapid-fire accessory provides the rigid positioning needed for bump firing. The operator 60 also places a forend hand 70 on the hand guard 32. While maintaining the trigger hand 80 in a relatively fixed position the operator uses the forend hand 70 to push the hand guard 32 forward. This movement shifts the semi-automatic firearm 6 forward relative to the trigger hand 80 and the rapid-fire accessory, which causes the trigger 15 to engage the trigger actuator (e.g., 122). As the trigger actuator pushes rearward on the trigger 15, the trigger moves rearward. If the operator 60 pushes forward far enough with the forend hand 70, the trigger actuator will pull the trigger enough to discharge the semi-automatic firearm 6.

The semi-automatic firearm 6 may start in the fired configuration F when the trigger actuator pulls the trigger 15 far enough to fire the semi-automatic firearm 6. Firing the semi-automatic firearm 6 propels the bullet 54 forward, but also causes a recoil force 50 that causes the semi-automatic firearm 6 to shift rearwards toward the operator 60. If the operator 60 holds the trigger hand 80 rigid/firm, and thus holds the rapid-fire accessory steady, the recoil force 50 will shift the semi-automatic firearm 6 rearwards into the ready-to-fire configuration R again. A semi-automatic firearm 6 in the ready-to-fire configuration R is once again ready to be fired. Thereafter, if the operator 60 maintains a forward force on the hand guard 32 while keeping the trigger hand 80 stationary in the rigid position (i.e., pulling the forend hand 70 away from the trigger hand 80), the operator 60 will be able to once again push the hand guard 32 forward after the recoil force 50 dissipates, which once again discharges the semi-automatic firearm 6. By continuously maintaining the forward force on the hand guard 32 with the trigger hand 80 held rigid/firm, the semi-automatic firearm 6 will discharge in a rapid-fire succession that is generally faster than what the operator 60 would achieve with repeated pulls of the trigger finger 82.

Figure 2B:
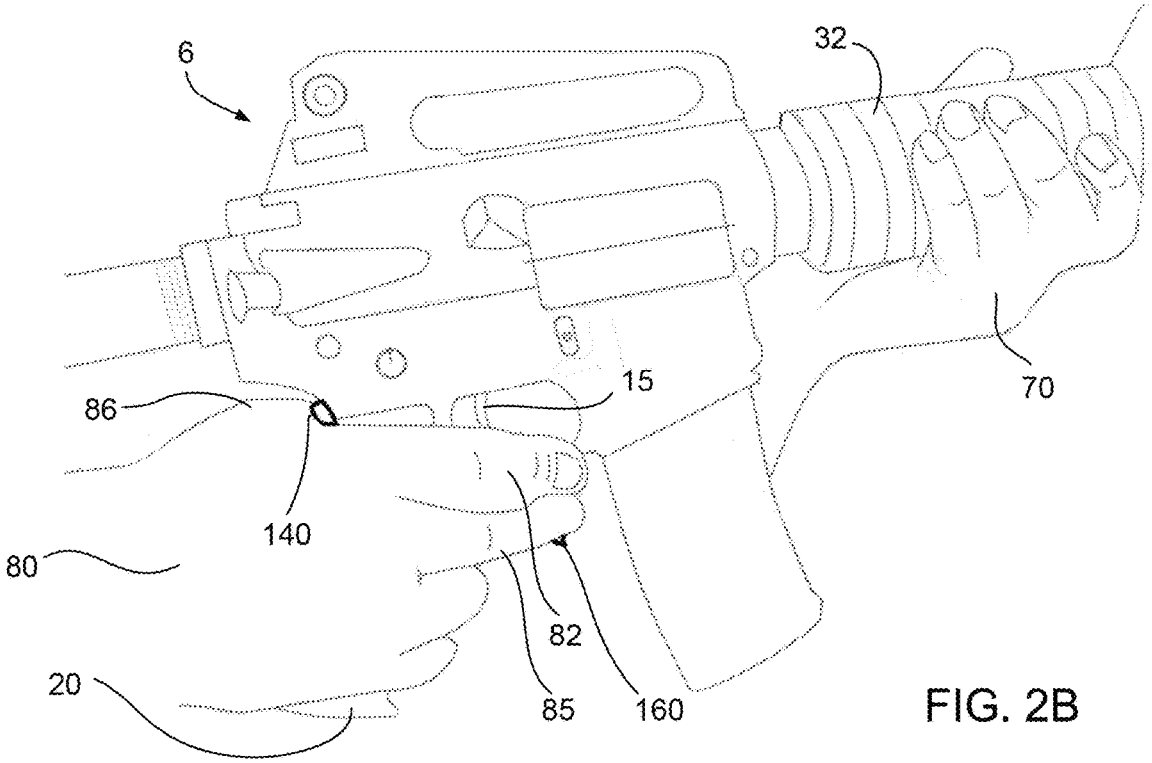
FIG. 2B illustrates a close-up view of the semi-automatic firearm of FIG. 2A being handled in the ready-to-fire configuration using a rapid-fire accessory in accordance with various embodiments.
Figure 2C:
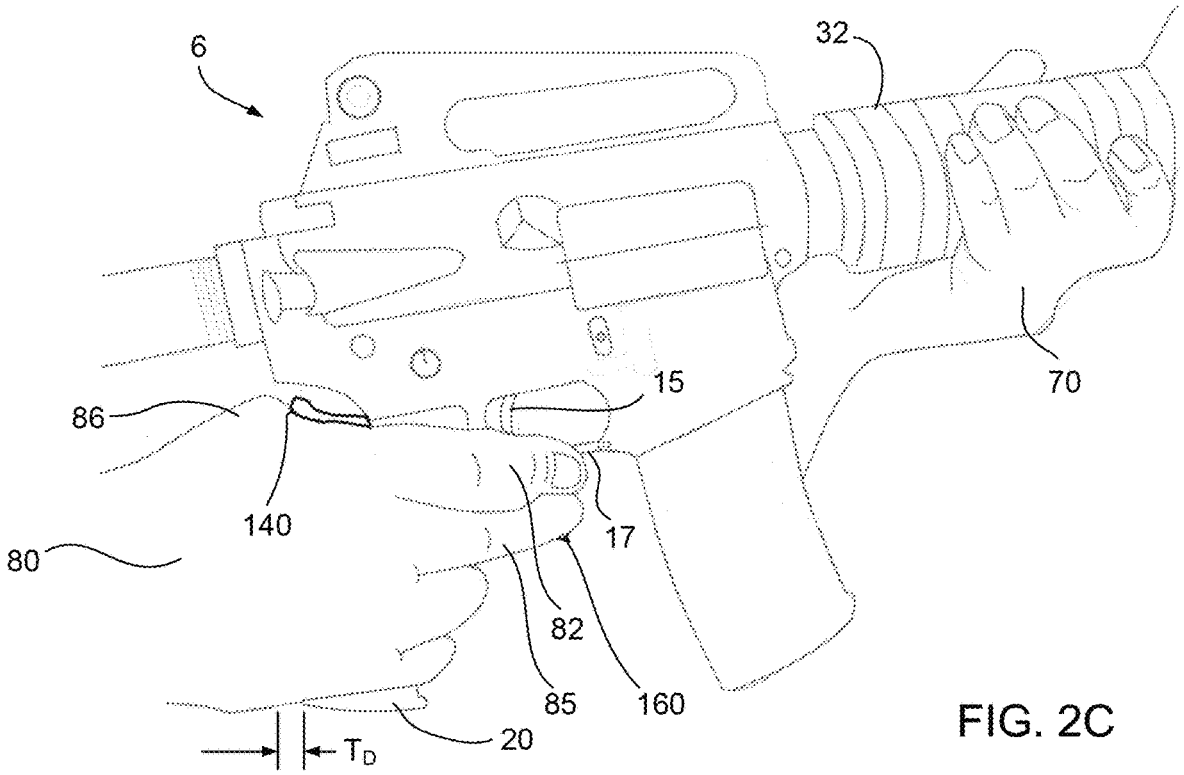
FIG. 2C illustrates a close-up view of the semi-automatic firearm of FIGS. 2A and 2C being handled in the fired configuration using a rapid-fire accessory in accordance with various embodiments.

FIGS. 2B and 2C illustrate close-up views of the semi-automatic firearm of FIG. 2A in the ready-to-fire and fired configurations, respectively, using the rapid-fire accessory (e.g., 100) in accordance with various embodiments. FIGS. 2B and 2C are similar to FIGS. 1A and 1B, but include the forend hand 70 and the trigger hand 80 on the semi-automatic firearm 6.

In FIG. 2B, the semi-automatic firearm 6 is in the ready-to-fire configuration with the trigger 15 of the semi-automatic firearm 6 in a forward position. In contrast in FIG. 2C, the semi-automatic firearm 6 is in a fired configuration with the trigger 15 in a rearward position. The operator (e.g., 60) may hold the rapid-fire accessory mounted on the semi-automatic firearm 6 with the trigger hand 80 wrapped loosely around the pistol grip 20 and firmly around the rapid-fire accessory. Meanwhile, to use the rapid-fire accessory to bump fire the semi-automatic firearm 6, the operator should grip the hand guard 32 with the forend hand.

To hold the rapid-fire accessory firmly, the operator may place a trigger-hand middle finger 85 on a forward side of the lower finger grip 160 and wrap a trigger-hand thumb 86 around a rear side of the thumb grip 140. By providing a squeezing pressure between the trigger-hand middle finger 85 and the trigger-hand thumb 86, the operator may maintain a steady and firm grip on the rapid-fire accessory. Optionally, a trigger finger 82 may rest on an outer edge of the mounting base 150 (as illustrated) or even placed across the trigger 15. However, when using the rapid-fire accessory of various embodiments, the operator does not need to actually touch the trigger 15 with any finger.

In FIG. 2C, the semi-automatic firearm 6 is in the fired configuration. The operator may move the semi-automatic firearm 6 into the fired configuration from the ready-to-fire configuration by gripping the hand guard 32 and pulling/pushing the semi-automatic firearm 6 forward relative to the rapid-fire accessory. In doing so, the pistol grip 20 may shift forward within the trigger hand 80 the same distance TD the rapid-fire accessory moves relative to the semi-automatic firearm 6.

FIGS. 3A-3D illustrate perspective views of the rapid-fire accessory 100 in accordance with various embodiments. The rapid-fire accessory 100 may be formed of metal, high-impact polymer, other suitable materials, or any combination thereof. The trigger guard mount 110 may be secured to or formed as an extension of the mounting base 150. The mounting base 150 may extend rearward beyond the trigger guard mount 110 in order to provide an additional guiding surface 151 along an underside of the trigger guard and/or adjacent surfaces of the semi-automatic firearm. For example, the mounting base 150 may extend rearward further than a trailing edge 112 of the trigger guard mount 110.

The trigger guard mount 110 includes a mounting channel 115 for receiving the trigger guard (e.g., 17) of the semi-automatic firearm. The mounting channel 115 may be formed as a U-shaped or rectangular slot extending through the entire the trigger guard mount 110 from a leading edge 111 to a trailing edge 112. The trigger guard mount 110 includes a receiving aperture 117, which forms an open side of the mounting channel 115. The trigger guard may be inserted into the mounting channel 115 through the receiving aperture 117. Once the trigger guard is seated fully within the mounting channel 115 and upper portion of the trigger guard mount 110 will be positioned above the trigger guard and a lower portion of the trigger guard mount 110 will be positioned below the trigger guard. Once positioned inside the mounting channel 115, the trigger guard may fit loosely therein in order to allow sliding movement between the trigger guard mount 110 and the trigger guard. A detent 118 may prevent the trigger guard from coming out of the mounting channel 115 laterally through the receiving aperture 117.

The trigger guard mount 110 includes a trigger recess 120 configured to receive a lower portion of the trigger (e.g., 15). Once the trigger guard mount 110 is mounted on the trigger guard, a lower portion of the trigger may be disposed in the trigger recess 120 (see, FIGS. 1A and 1B). In addition, a forward wall of the trigger recess 120 may form the trigger actuator 122.

The trigger guard mount 110 may include a trigger finger grip 132. The trigger finger grip 132 may provide a more traditional gripping place for the trigger finger of an operator. The trigger finger grip 132 may be formed into a forward facing edge of a lateral wall that extends upward from a left lateral side of an upper portion of the trigger guard mount 110 and the mounting base 150. Trigger finger grip 132 may be configured to align with a shape and position of the trigger once the rapid-fire accessory is mounted on the semiautomatic firearm (see, FIG. 4D). In this way, the operator holding the rapid-fire accessory 100 may extend a trigger finger laterally across a front of the trigger and grip the trigger finger on the trigger finger grip 132. Depending on the design and the particular arched shape of the trigger finger grip 132, the trigger hand finger of the operator may simultaneously engage (i.e., rest on) the trigger finger grip 132 and the trigger during bump fire sequences, the trigger will generally move in unison with the trigger finger grip 132.

The trigger actuator 122 pulls the trigger. Thus, the operator need not directly engage the trigger with any finger. Optionally, and extension wall 135 may extend to the leading edge 111 of the trigger guard mount 110. The extension wall 135 may provide an additional guide surface on a lateral side of the weapon's receiver. In addition, the extension wall 135 may prevent some operators from resting their trigger finger on the trigger, which may help train the operator not to hold the trigger finger on the trigger when bump firing. As a further alternative, the extension wall 135 may be included as a removable section, giving the operator (or owner) the option to remove or customize the extension wall 135.

The rapid-fire accessory may include a lower finger grip 160 protruding from a lower portion of the trigger guard mount 110 and/or the mounting base 150. The lower finger grip 160 may include a finger engagement surface 162, on a forward facing side of the lower finger grip 160. The finger engagement surface 162 may include contours designed with an ergonomic shape that allows the operator to comfortably and/or securely hold the rapid-fire accessory. For example, FIGS. 2B and 2C illustrate the operator holding a trigger-hand middle finger 85 on the lower finger grip 160.

FIGS. 4A-4D illustrate a front elevation, rear elevation, top plan, and right side partial section views, respectively, of a partially formed rapid-fire accessory 101 in accordance with various embodiments.

The rapid-fire accessory 100 described above with reference to FIGS. 1A-2C may formed by and/or include all or most of the features described herein with regard to the partially formed rapid-fire accessory 101. Thus, the description herein of the partially formed rapid-fire accessory 101 and components thereof may apply to corresponding components of the rapid-fire accessory 100. The partially formed rapid-fire accessory 101, like the rapid-fire accessory 100, includes a trigger guard mount 110, a trigger actuator 122, an extension member 130, a mounting base 150, and a lower finger grip 160, further details of which are described below.

In FIGS. 4A-4D, the partially formed rapid-fire accessory 101 includes an unfinished thumb grip section 141, which is formed as a planar end portion of an extension member 130 that extends from the trigger guard mount 110. The unfinished thumb grip section 141 may be formed as an intermediate step in forming a thumb grip (e.g., 140) that is contoured for engagement with a trigger-hand thumb (e.g., 86). For example, the partially formed rapid-fire accessory 101 may be formed by molding, 3-D printing, and/or an assembly of separate parts. Subsequent to forming/assembling the partially formed rapid-fire accessory 101, the unfinished thumb grip section 141 may be altered to create a thumb grip (e.g., 140) with a thumb engagement surface (e.g., 142). The alterations of the unfinished thumb grip section 141 may be performed as part of manufacturing or left for an end-user and/or operator. Thus, the partially formed rapid-fire accessory 101 may be provided with an unfinished thumb grip section 141 for an end-user and/or operator to custom mold for their particular semi-automatic firearm.

Figure 4A:
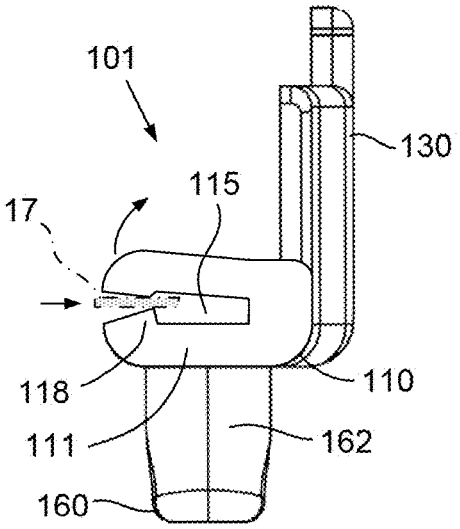
FIG. 4A illustrates a front elevation view of a partially formed rapid-fire accessory, with a portion of a trigger guard in phantom, in accordance with various embodiments.
Figure 4B:
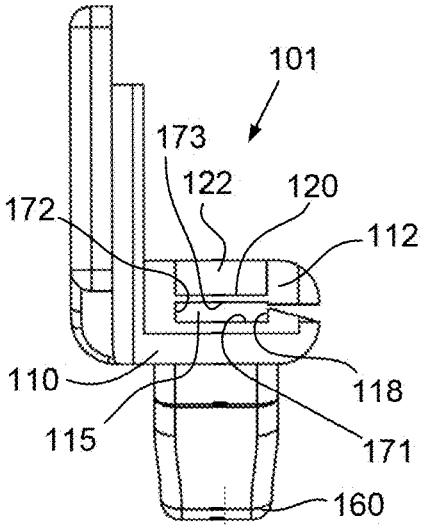
FIG. 4B illustrates a rear elevation view of the partially formed rapid-fire accessory of FIG. 4A in accordance with various embodiments.
Figure 4C:
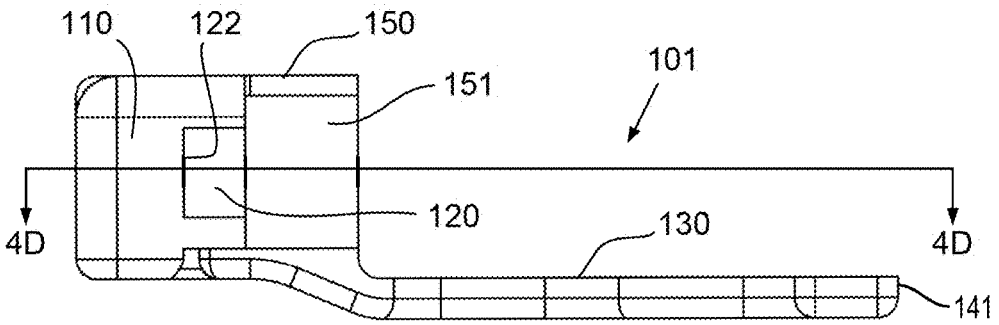
FIG. 4C illustrates a top plan view of the partially formed rapid-fire accessory of FIGS. 4A and 4B in accordance with various embodiments.
Figure 4D:
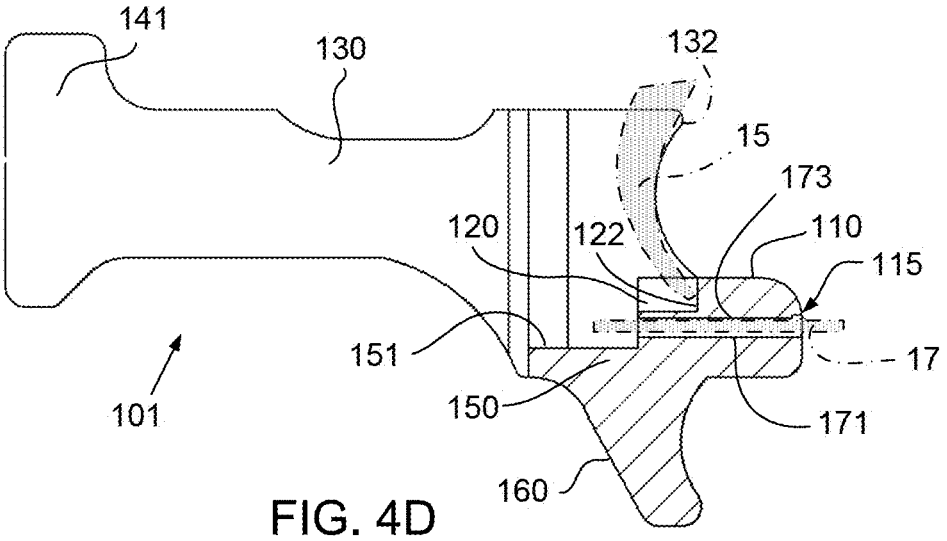
FIG. 4D illustrates a right side partial-section view at 4D-4D in FIG. 4C of the partially formed rapid-fire accessory of FIGS. 4A-4C, with a portion of a trigger and a trigger guard in phantom, in accordance with various embodiments.

Some elements of the mounting channel 115 are visible in FIGS. 4A, 4B, and 4D. In particular, a full extent of the mounting channel 115 is illustrated, which extends through the entire the trigger guard mount 110 from the leading edge 111 toward the rear of the partially formed rapid-fire accessory 101. The mounting channel 115 may be formed with a lower wall 171, and upper wall 173 opposed to the lower wall 171, and a lateral wall 172 connecting the lower wall 171 and the upper wall 173 (see, FIG. 4B). FIG. 4D illustrates that when the trigger guard 17 is mounted in the mounting channel 115 (i.e., fully inserted in the mounting channel), the upper wall 173 is disposed between a bottom of the trigger 15 and the trigger guard 17. In addition, the mounting channel 115 may be sized slightly larger than the trigger guard 17 to allow the trigger guard 17 to slide forward and rearward therein. In this way, when the trigger guard mount 110 and the trigger guard 17 move relative to one another, the trigger guard 17 may be in sliding engagement with at least one of the lower wall 171 and the upper wall 173 during the sliding movement.

The mounting channel 115 may include a receiving aperture 117 for inserting the trigger guard in the mounting channel 115. FIG. 4A illustrates the trigger guard 17 (shown in phantom lines with gray fill) partially inserted in the mounting channel 115. The receiving aperture 117 may be formed as a narrow slit extending the length of the mounting channel 115. The receiving aperture 117 may be narrower than a thickness of the trigger guard 17. Thus, a portion of the trigger guard mount 110 must be moved from an initial position, such as by slightly flexing a portion of the trigger guard mount in order to increase a width of the receiving aperture 117 enough to allow the trigger guard to be inserted into the mounting channel 115 through the receiving aperture 117. For example, FIG. 4A illustrates an upper portion of the trigger guard mount 110 being flexed upward with a portion of the trigger guard 17 being inserted into the mounting channel 115. Similarly, once the trigger guard is seated fully within the mounting channel 115, a portion of the trigger guard mount 110 may once again be flexed upward to increase the width of the receiving aperture 117 enough to release and/or remove the trigger guard 17 from the mounting channel 115.

The trigger guard mount 110 may include a detent 118 that protrudes across a portion of the receiving aperture 117 for trapping the trigger guard in the mounting channel. In various embodiments, the detent 118 extends the full length of the mounting channel 115, but the detent 118 may be shorter or longer than the full extent of the mounting channel 115. Thus, the detent 118 may be moved, as part of flexing the portion of the trigger guard mount 110 from the initial position, in order to enable the trigger guard 17 to be inserted in the mounting channel 115.

Alternatively, other means for trapping the trigger guard in the mounting channel 115 may be provided. Rather than a fixed structure like the detent 118, a retractable detent may be provided. For example, a retractable detent may be formed as a ball bearing or pin supported from below by a compressible spring. A retractable detent may thus selectively trap the trigger guard until sufficient pressure lowers or moves aside the retractable detent for releasing the trigger guard from the mounting channel 115. As a further example, a releasable clasp, pivotal latch, or other adjustable structure may be provided that may temporarily block all or a portion of the receiving aperture 117 to selectively trap/release the trigger guard in/from the mounting channel 115.

Figure 5A:
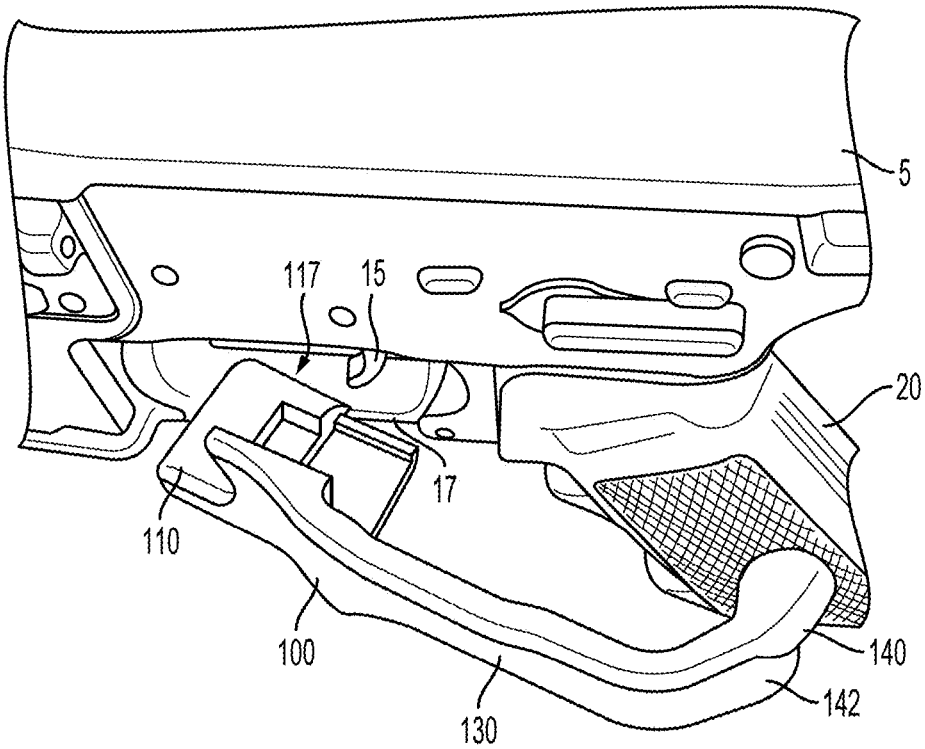
FIG. 5A illustrates a rear left-side downward-looking perspective view of a rapid-fire accessory partially mounted on a semi-automatic firearm in accordance with various embodiments.
Figure 5B:
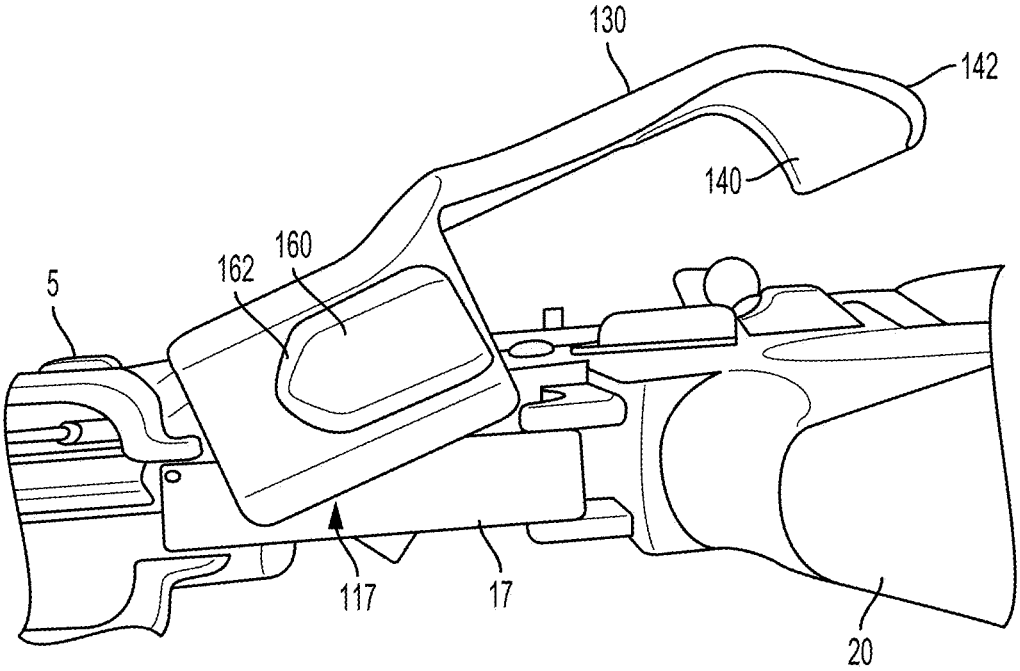
FIG. 5B illustrates a bottom view of the rapid-fire accessory partially mounted on a semi-automatic firearm of FIG. 5A in accordance with various embodiments.

FIGS. 5A and 5B illustrate the rapid-fire accessory 100 partially mounted onto the semi-automatic firearm 5. To install the rapid-fire accessory 100 on the semi-automatic firearm 5, an operator or other individual may align the receiving aperture 117 of the rapid-fire accessory 100 with the trigger guard 17 of the semi-automatic firearm 5. Once properly positioned, pressing the trigger guard mount 110 into the trigger guard 17 may expand the receiving aperture 117, at least until the trigger guard 17 clears the detent (e.g., 118). It may be helpful to first insert a right leading edge corner of the trigger guard mount 110 onto the trigger guard 17. Once the trigger guard 17 is at least partially inserted into the mounting channel (e.g., 115), the operator or other individual may pivot the thumb grip 140 (i.e., the rear portion of the rapid-fire accessory 100) toward the pistol grip 20 until the thumb grip 140 is positioned rearward of the pistol grip 20.

Figure 3A:
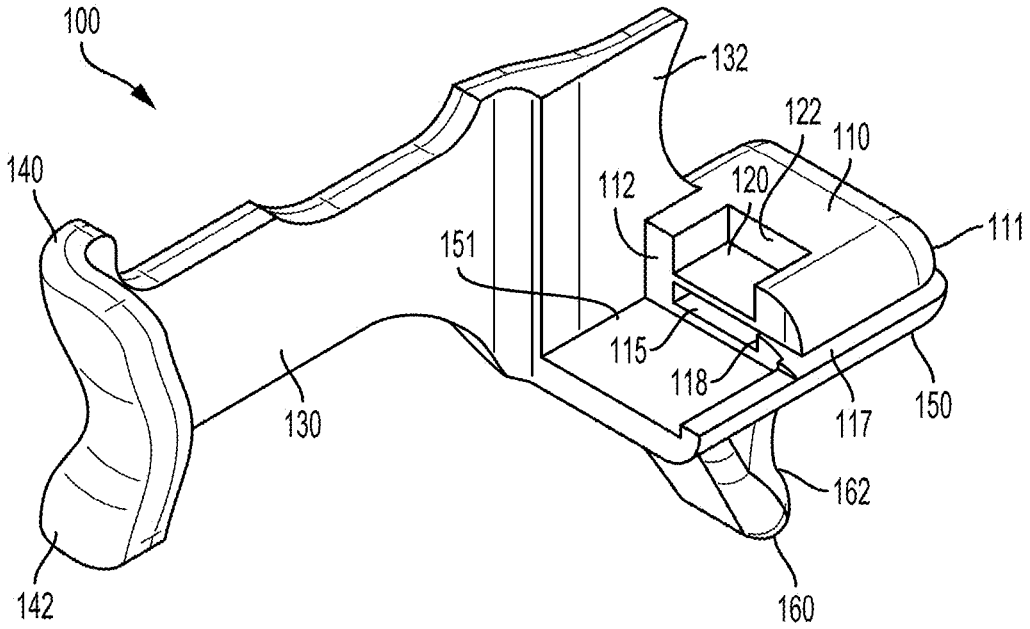
FIG. 3A illustrates a rear-right side downward-looking perspective view of a rapid-fire accessory in accordance with various embodiments.
Figure 3B:
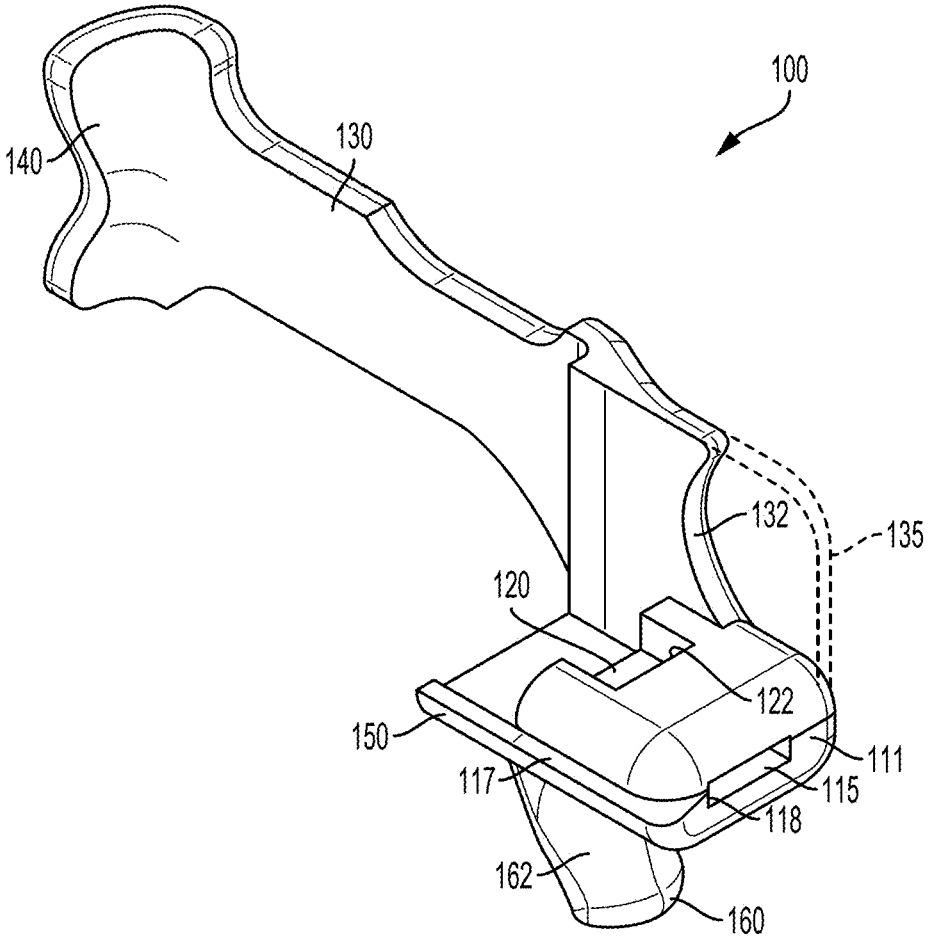
FIG. 3B illustrates a forward-left side downward-looking perspective view of the rapid-fire accessory of FIG. 3A in accordance with various embodiments.
Figure 3C:
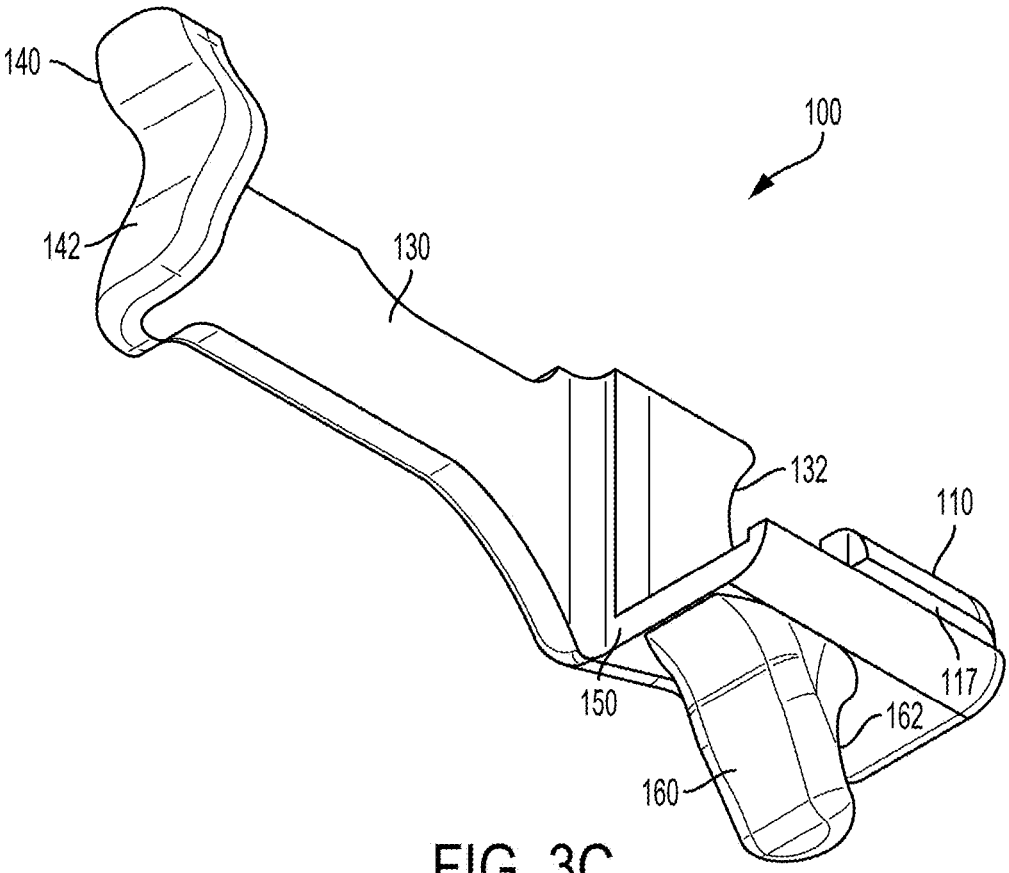
FIG. 3C illustrates a rear-right side upward-looking perspective view of the rapid-fire accessory of FIGS. 3A and 3B in accordance with various embodiments.
Figure 3D:
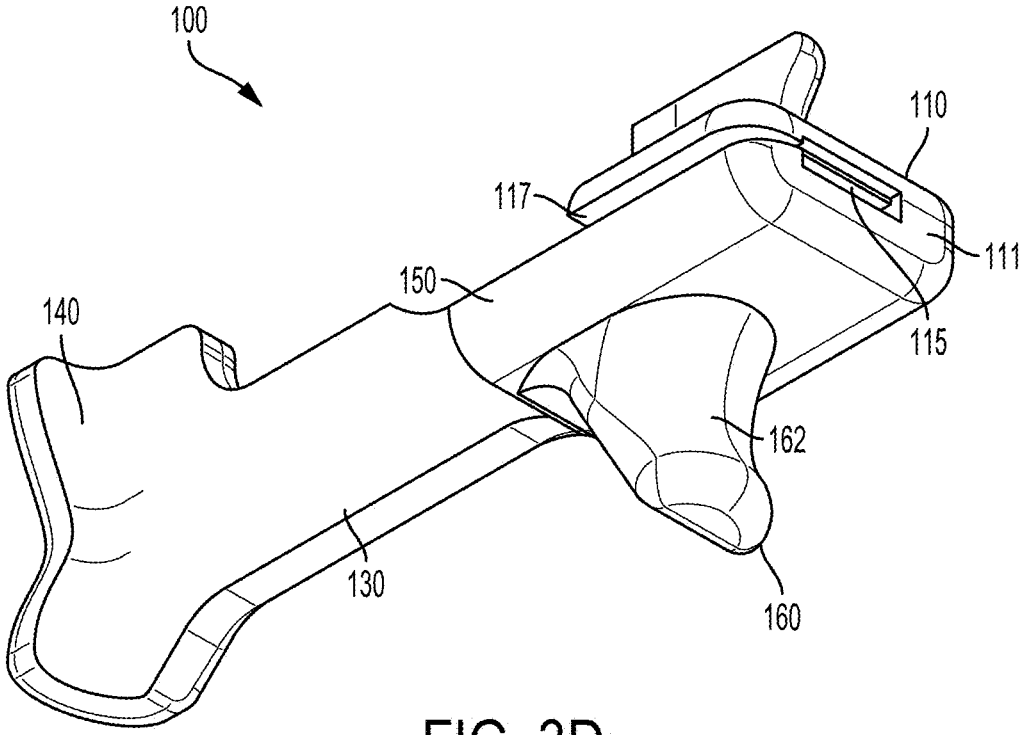
FIG. 3D illustrates a forward-left side upward-looking perspective view of the rapid-fire accessory of FIGS. 3A-3C in accordance with various embodiments.

Some elements of the thumb grip 140 and the thumb engagement surface 142 are visible in FIGS. 5A and 5B. In particular, the extension member 130 extends rearward from a lateral side of the trigger guard mount 110 and connects the thumb grip 140 to the trigger guard mount 110 and/or the mounting base 150. The thumb grip 140 may be molded and/or formed to wrap around a rear upper side of the pistol grip 20. In this way, the extension member 130 extends rearward away from the trigger actuator 122, placing the thumb grip 140 on the backside of the pistol grip 20, which is remote from the trigger guard mount 110. In addition, the thumb grip 140 may include a contoured rear surface that forms the thumb engagement surface 142. The thumb engagement surface 142 is thus configured to engage the operator's trigger-hand thumb (e.g., 86), particularly while the operator is firing the semi-automatic firearm 5. As shown in FIGS. 3A, 3C, and 5A, the thumb engagement surface 142 may be ergonomically contoured for comfortable and/or secure engagement by an appropriate portion of the trigger-hand thumb. Alternatively, the thumb engagement surface 142 may be flat, have a different contour, or a different shape.

Figure 6A:
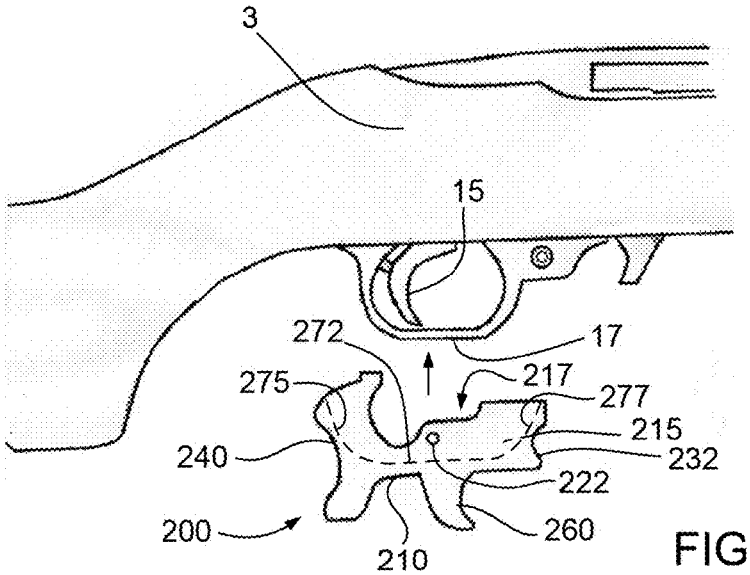
FIG. 6A illustrates a side elevation view of a rapid-fire accessory positioned separate from and below a semi-automatic firearm in accordance with various embodiments.
Figure 6B:
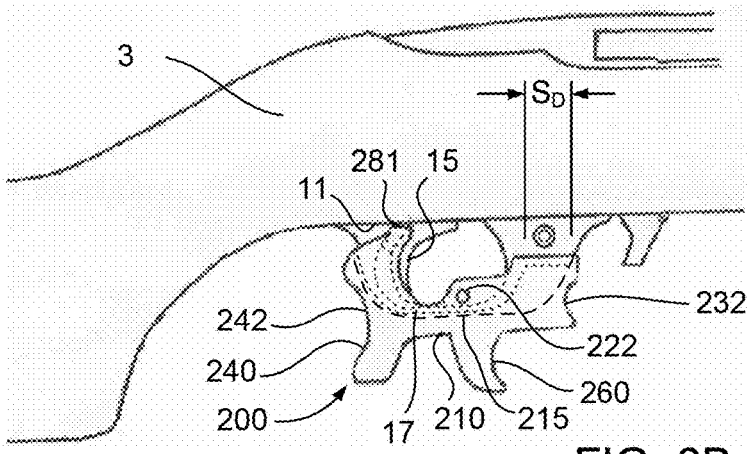
FIG. 6B illustrates a side elevation view of the rapid-fire accessory and the semi-automatic firearm of FIG. 6A attached together with the semi-automatic firearm in a ready-to-fire configuration in accordance with various embodiments.
Figure 6C:
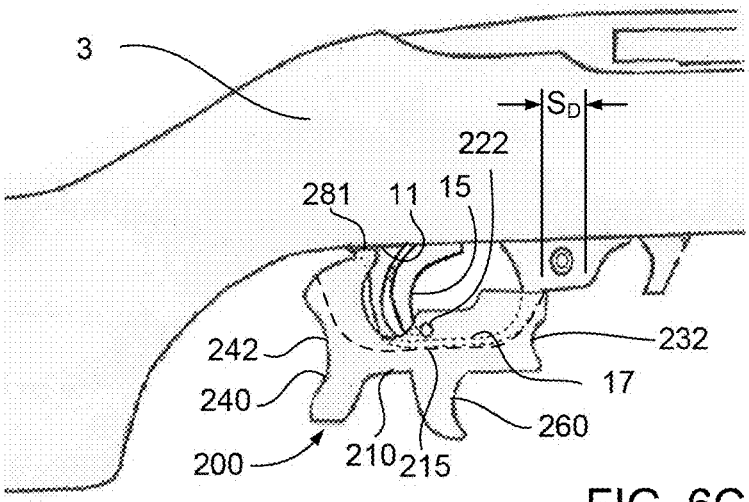
FIG. 6C illustrates a side elevation view of the rapid-fire accessory and the semi-automatic firearm of FIG. 6A attached together with the semi-automatic firearm in a fired configuration in accordance with various embodiments.

FIGS. 6A-6C illustrate a rapid-fire accessory 200 used with a semi-automatic firearm 3, with a conventional rifle stock (rifle without an adjustable butt stock and pistol grip), in accordance with various embodiments. FIG. 6A illustrates a central portion of the semi-automatic firearm 3 with the rapid-fire accessory 200 separate there from. FIG. 6B illustrates the semi-automatic firearm 3 of FIG. 6A in a ready-to-fire configuration with the rapid-fire accessory 200 mounted thereon. FIG. 6C illustrates the semi-automatic firearm 3 of FIG. 6A in a fired configuration with the rapid-fire accessory 200 mounted thereon. In the orientations illustrated in 6A-6C, the semi-automatic firearm 3 is aiming to the right, which is referred to herein as a "forward" direction, which is opposed to a "rearward" direction aiming to the left, as illustrated. Various features of the semi-automatic firearm 3 are also illustrated including a trigger 15 and a trigger guard 17.

In various embodiments, the rapid-fire accessory 200 includes a trigger guard mount 210 for attaching the rapid-fire accessory 200 to the semi-automatic firearm 3. In some embodiments, the trigger guard mount 210 is a central portion of the rapid-fire accessory 200. An operator may secure the rapid-fire accessory 200 to the semi-automatic firearm 3 by fitting the trigger guard mount 210 onto the trigger guard 17 from a bottom side of the semi-automatic firearm 3. The trigger guard mount 210 includes a mounting channel 215 for receiving the trigger guard 17 of the semi-automatic firearm 3. An upper side of the trigger guard mount 210 is open, formed with a receiving aperture 217 through which the trigger guard 17 may be inserted into the mounting channel 215.

In FIG. 6B, the semi-automatic firearm 3 is in a ready-to-fire configuration with the trigger 15 of the semi-automatic firearm 3 in a forward position. From the ready-to-fire configuration, pulling the trigger 15 (i.e., pivoting or moving the trigger 15 rearward—toward the left as illustrated) will discharge the semi-automatic firearm 3. In contrast in FIG. 6C, the semi-automatic firearm 3 is in a fired configuration with the trigger 15 in a rearward position. From the ready-to-fire configuration (e.g., FIG. 6B), an operator generally holds the rapid-fire accessory 200 in a relatively fixed position while pushing the semi-automatic firearm 3 forward into the firing configuration (e.g., FIG. 6C), which discharges the semi-automatic firearm 3. The operator may hold the rapid-fire accessory 200 by placing one trigger-hand finger, such as a trigger-hand middle finger, on a forward side of a lower finger grip 260 while wrapping a trigger-hand thumb around a rear side of a thumb grip 240 onto a thumb engagement surface 242.

The trigger guard 17, when mounted in the mounting channel 215, guides a sliding movement of the trigger guard mount 210, and the overall rapid-fire accessory 200, forward and rearward relative to the semi-automatic firearm 3. The trigger guard 17 may be in sliding engagement with a lower wall 272 (see, FIGS. 6A and 7C) of the mounting channel 215 during the forward and/or rearward movement. In addition, as the trigger guard 17 moves relative to the mounting channel 215, the overall semi-automatic firearm 3 moves relative to the rapid-fire accessory 200. The semi-automatic firearm 3 shifts a distance $S_D$ between the ready-to-fire configuration and the firing configuration, which may be equal to or slightly further than the distance the trigger 15 is pulled after being reset for discharging the semi-automatic firearm 3.

The rapid-fire accessory 200 may additionally include supplemental sliding engagement surfaces 281. The supplemental sliding engagement surfaces 281 may stabilize the sliding movement of the rapid-fire accessory 200, which may otherwise pitch and/or twist retarding movement relative to the trigger guard 17. The supplemental sliding engagement surfaces 281 may be configured to slide along a linear surface 11 of the semi-automatic firearm 3. Optionally, the supplemental sliding engagement surfaces 281 may extend from other parts of the rapid-fire accessory for engaging and sliding along other surfaces of the semi-automatic firearm 3. In addition, additional supplemental sliding engagement surfaces 281 may be provided.

The rapid-fire accessory 200 also includes a trigger actuator 222 for engaging the trigger 15 of the semi-automatic firearm 3. Fixed relative to the mounting channel 215, the trigger actuator 222 is configured to pull the trigger 15 when the trigger guard 17 slides forward in the mounting channel 215. In various embodiments, the trigger actuator 222 may include a pin or other structure that extends laterally across the mounting channel. As illustrated in FIG. 6C, a lower tip of the trigger 15 may be disposed in the mounting channel and/or rearward of the trigger actuator 222. The trigger guard 17 sliding forward in the mounting channel 215 also means the semi-automatic firearm 3 is sliding forward relative to the rapid-fire accessory 200. This sliding movement causes the trigger actuator 222 to engage the lower tip of the trigger 15, pulling the trigger 15 rearward, which discharges the semi-automatic firearm 3. With the operator continuing to hold the rapid-fire accessory 200 in a relatively fixed position, the discharge of the semi-automatic firearm 3 causes a recoil force that moves the semi-automatic firearm 3 rearward relative to the rapid-fire accessory 200, which returns the semi-automatic firearm 3 to the loaded configuration (e.g., FIG. 6B).

A rear wall 275 of the mounting channel 215 may act as a stop, preventing further rearward relative movement of the trigger guard 17 relative to the rapid-fire accessory 200. Engagement of the trigger guard 17 with the rear wall 275 may also coincide with the semi-automatic firearm 3 being in the ready-to-fire configuration, which automatically rechambers another cartridge into the weapon. Thereafter, if the operator maintains a forward force on the hand guard of the semi-automatic firearm 3, while keeping the trigger hand stationary (i.e., pulling the forend hand away from the trigger hand), the operator will be able to once again push the semi-automatic firearm 3 forward after the recoil force dissipates, which once again discharges the semi-automatic firearm 3 once the firing configuration is reached. A forward wall 277 of the mounting channel 215 may act as a forward stop, preventing further forward relative movement of the trigger guard 17 relative to the rapid-fire accessory 200. By continuously maintaining the forward force on the hand guard with the trigger hand held steady, the semi-automatic firearm 3 will discharge in a rapid-fire succession like that of freehand bump fire techniques. However, unlike freehand bump fire techniques, use of the rapid-fire accessory 200 is easier to learn and does not involve elaborate and/or expensive accessories.

Figure 7A:
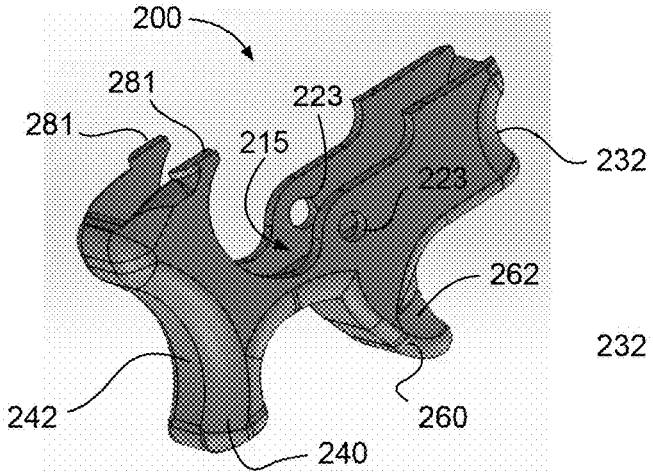
FIG. 7A illustrates a rear-right side downward-looking perspective view of the rapid-fire accessory of FIG. 6A-6C, without a trigger actuator, in accordance with various embodiments.
Figure 7B:
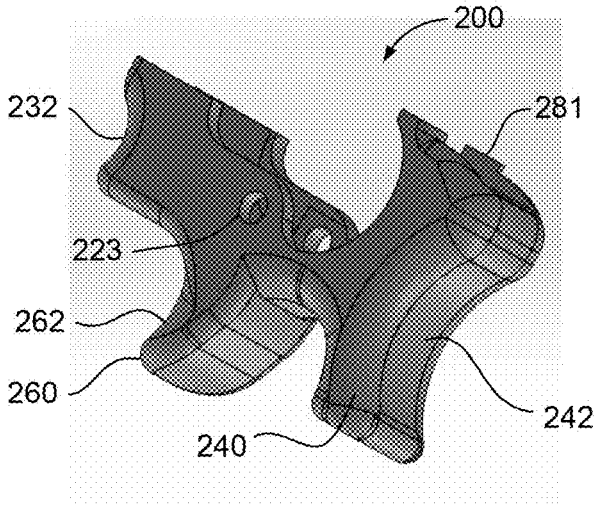
FIG. 7B illustrates a forward-left side perspective view of the rapid-fire accessory of FIG. 6A-7A, without a trigger actuator, in accordance with various embodiments.
Figure 7C:
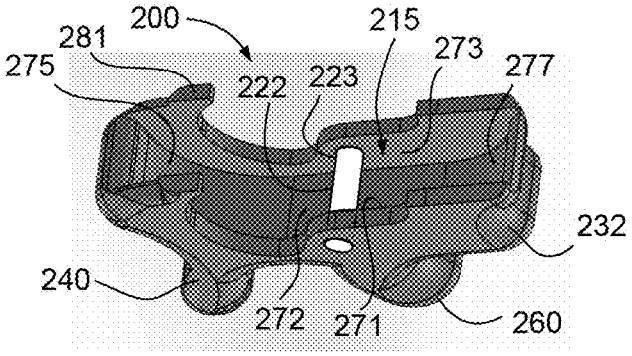
FIG. 7C illustrates a forward-right side downward-looking perspective view of the rapid-fire accessory of FIG. 6A-7B, with a trigger actuator installed, in accordance with various embodiments.
Figure 7D:
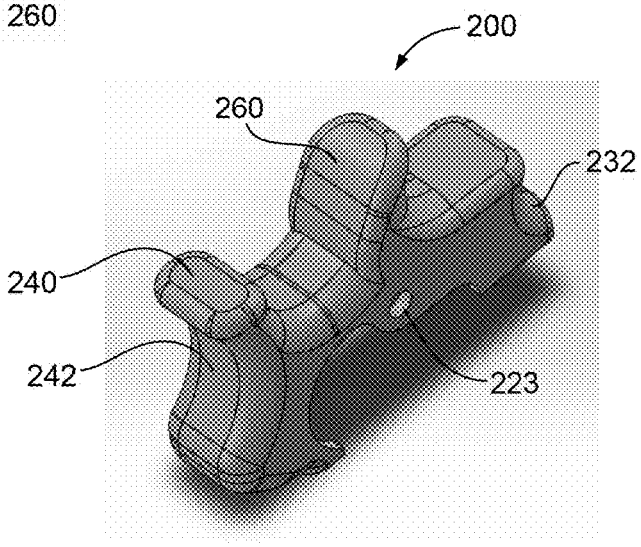
FIG. 7D illustrates a rear-left side upward-looking perspective view of the rapid-fire accessory of FIG. 6A-7C, without a trigger actuator, in accordance with various embodiments.
Figure 8A:
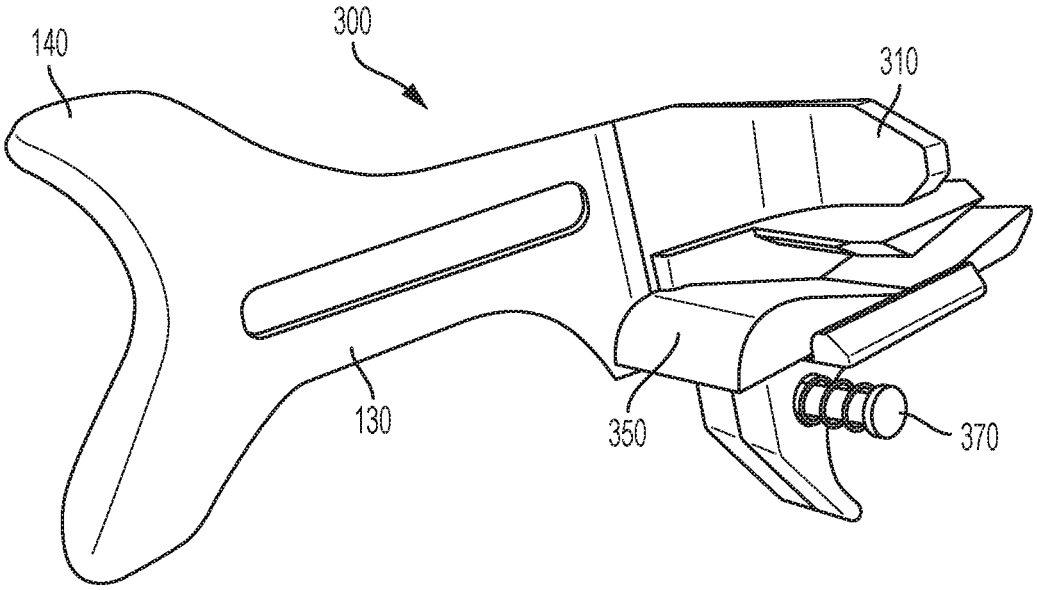
FIG. 8A illustrates a rear-right side downward-looking perspective view of a rapid-fire accessory in accordance with various embodiments.
Figure 8B:
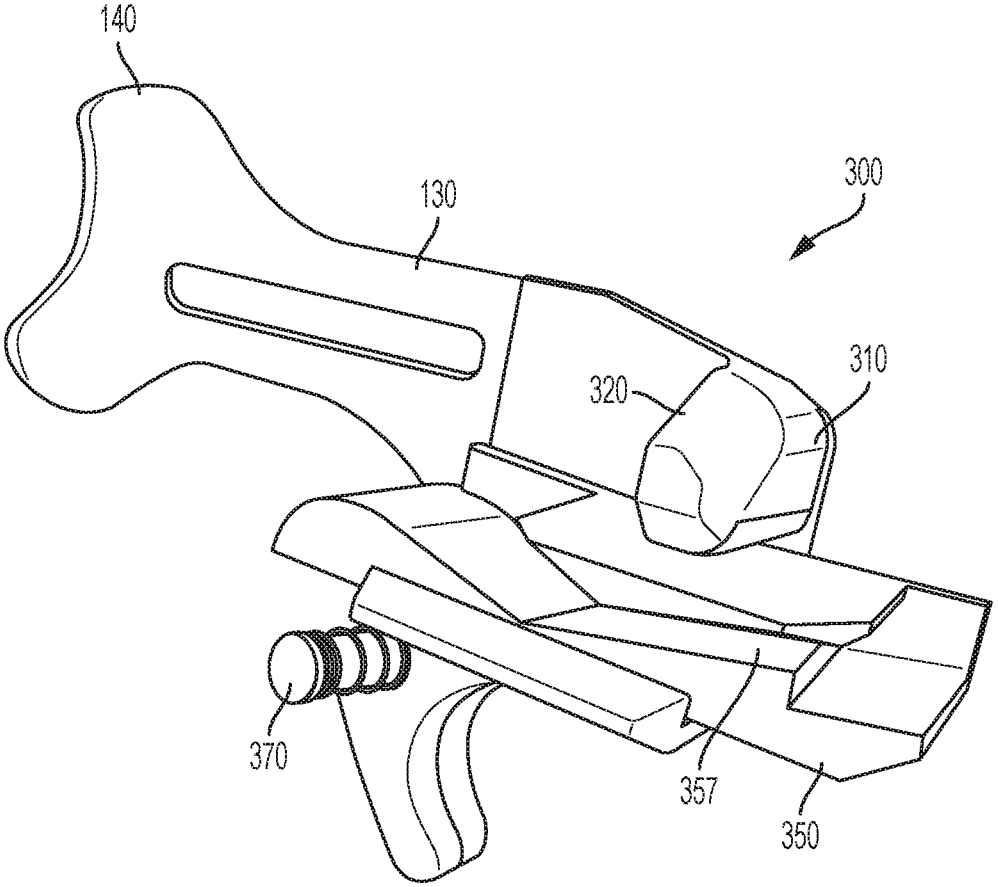
FIG. 8B illustrates a forward-left side downward-looking perspective view of the rapid-fire accessory of FIG. 8A in accordance with various embodiments.
Figure 8C:
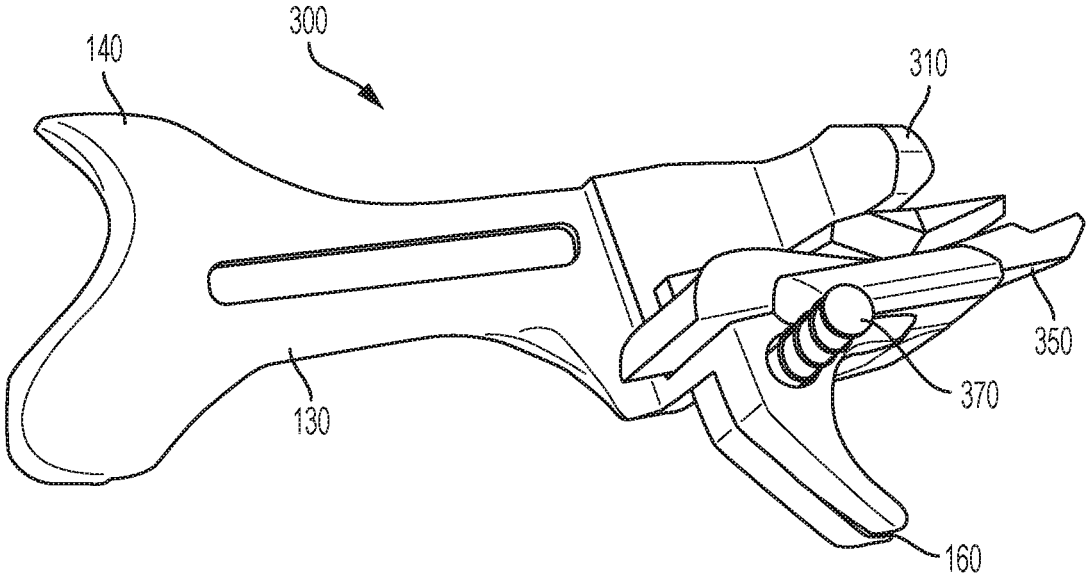
FIG. 8C illustrates a rear-right side upward-looking perspective view of the rapid-fire accessory of FIGS. 8A and 8B in accordance with various embodiments.
Figure 8D:
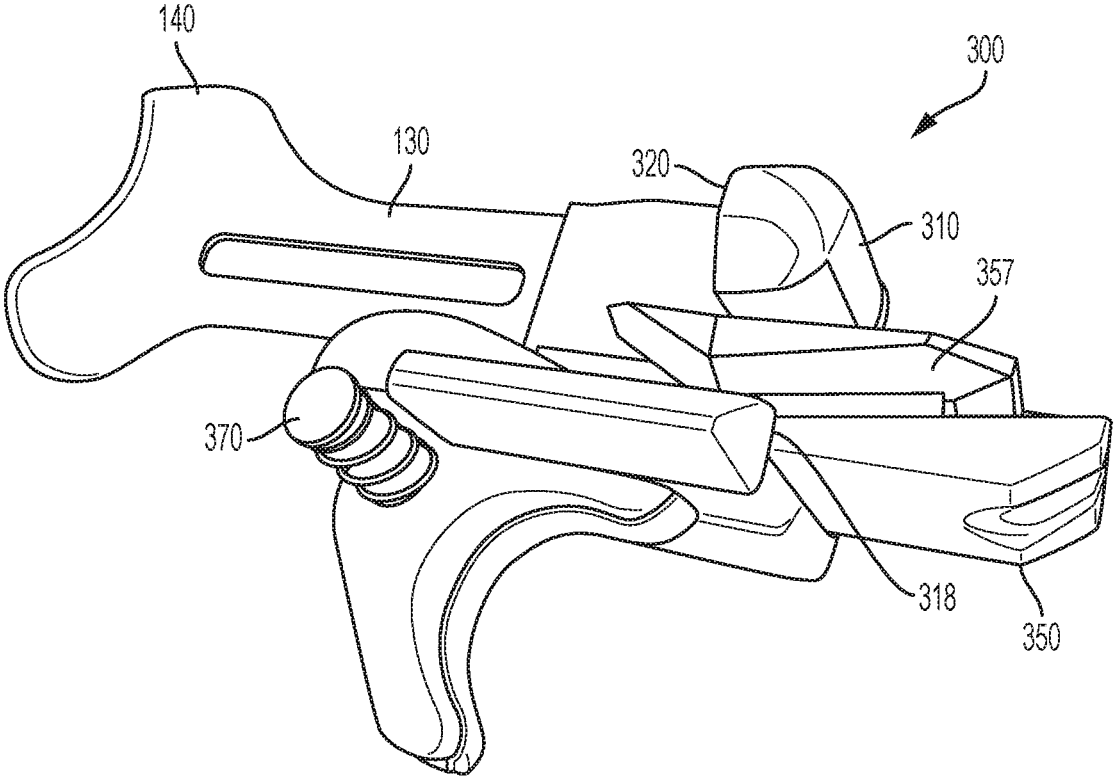
FIG. 8D illustrates a forward-left side upward-looking perspective view of the rapid-fire accessory of FIGS. 8A-8C in accordance with various embodiments.
Figure 8E:
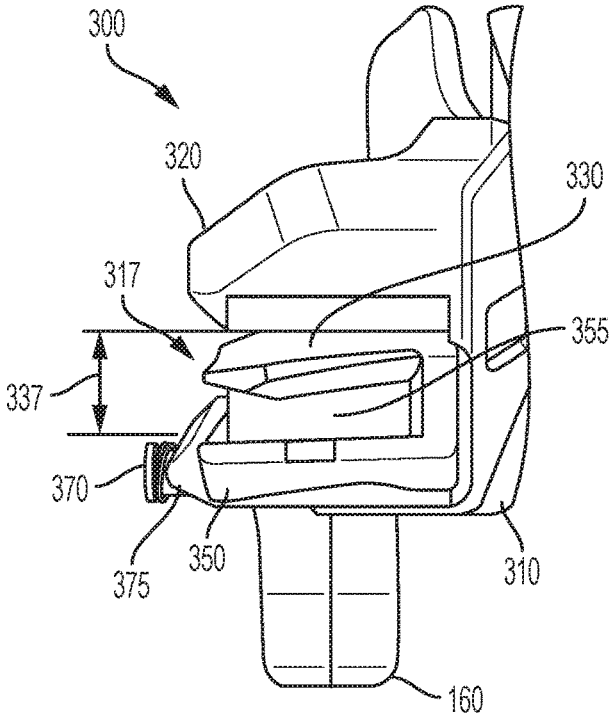
FIG. 8E illustrates a front view of the rapid-fire accessory of FIGS. 8A-8 in accordance with various embodiments.

FIGS. 7A-7D illustrate the rapid-fire accessory 200 in accordance with various embodiments. Some elements of the thumb grip 240 and the thumb engagement surface 242 are visible in FIGS. 7A, 7B, and 7D. In particular, a rearward portion of the trigger guard mount 210 may include a downward protruding horn that together with an outside of the rear wall 275 forms the thumb grip 240. In this way, the thumb grip 240 may be disposed rearward from the trigger actuator 222. The thumb grip 240 may be molded and/or formed to include a contoured rear surface that forms the thumb engagement surface 242. The thumb engagement surface 242 is thus configured to engage the operator's trigger-hand thumb (e.g., 86), particularly while the operator is firing the semi-automatic firearm 3. As shown in FIGS. 7A, 7B, and 7D, the thumb engagement surface 242 may be ergonomically contoured for comfortable and/or secure engagement by an appropriate portion of the trigger-hand thumb. Alternatively, the thumb engagement surface 242 may be flat, have a different contour, or a different shape.

The rapid-fire accessory 200 may include a lower finger grip 260 protruding from a lower forward portion of the trigger guard mount 210. The lower finger grip 260 may include a finger engagement surface 262, on a forward facing side of the lower finger grip 260. The finger engagement surface 262 may include contours designed with an ergonomic shape that allows the operator to comfortably and/or securely hold the rapid-fire accessory 200.

The rapid-fire accessory 200 may include a trigger finger grip 232. The trigger finger grip 232 may provide a gripping place for the trigger finger of the operator, which is forward of the more conventional trigger hand finger position on the trigger. The trigger finger grip 232 may be formed on an outside of the forward wall 277, which places the trigger finger grip 232 at an opposite end of the mounting channel 215 from the thumb grip 240. The trigger finger grip 232 may be disposed forward of the trigger actuator 222. Thus, using all the grip surfaces included on the rapid-fire accessory 200, the operator may simultaneously place a trigger-hand thumb on the thumb grip 240, a trigger-hand middle finger on the lower finger grip 260, and a trigger hand finger on the trigger finger grip 232.

Some elements of the mounting channel 215 are visible in FIG. 7C. In particular, the mounting channel 215 includes a right wall 271, a left wall 273 opposed to the right wall 271, and a lower wall 272 connecting the right wall 271 to the left wall 273. In addition, the mounting channel 215 extends from the rear wall 275 to the forward wall 277 opposed to the rear wall 275. Once mounted in the mounting channel 215, the trigger guard may slide along the lower wall 272 during sliding movements.

FIG. 7C also shows the trigger actuator 222 extending from the right wall 271 to the left wall 273. The trigger actuator 222 may be a removably secured element (e.g., a locking bar or pin) held in a pair of apertures 223. The trigger actuator 222 may be pressure-fit in one or both of the apertures 223. Additionally or alternatively, the trigger actuator 222 may be formed as a double-sided screw with larger screw heads engaging the right and left walls 271, 273. A first aperture 223 may be disposed in the right wall 271 and a second aperture 223 may be disposed opposite the first aperture in the left wall 273. The trigger actuator 222 may be removed in order to allow the trigger guard to be fully seated within the mounting channel 215. Once the trigger guard is fully seated in the mounting channel 215, the trigger actuator 222 inserted into the apertures 223 may extend across the mounting channel 215 from the right wall 271 to the left wall 273. In addition, once the trigger guard is fully seated in the mounting channel 215, the trigger guard may be disposed between the trigger actuator 222 and the lower wall 272.

The trigger actuator 222 may be held in-place in the apertures 223 through a simple friction fit. Further still, the trigger actuator 222 may be formed as a push button pin or other quick release pin. Alternatively, further fixation elements may be provided on or with the trigger actuator 222 such as a hair pin style locking pin, a ball lock pin, or double ball detent pins. Thus, the trigger actuator 222 may be removably secured to at least one of the right wall 271 and the left wall 273. In addition, removal of the trigger actuator 222 releases the trigger guard from the mounting channel 215.

FIGS. 8A-8E illustrate various views of a rapid-fire accessory 300, that includes a trigger guard adapter, in accordance with various embodiments. The rapid-fire accessory 300 may be similar in many regards to the rapid-fire accessory 100, described above with regard to FIGS. 1A-5B. Thus, like numbered elements of both the rapid-fire accessories 100, 300 may be similar or the same. For example, the rapid-fire accessory 300 may include an extension member 130, a thumb grip 140, and a lower finger grip 160. In addition, like the rapid-fire accessory 100, the rapid-fire accessory 300 may be formed of metal, high-impact polymer, other suitable materials, or any combination thereof.

In various embodiments, the rapid-fire accessory 300 includes a trigger guard mount 310 for attaching the rapid-fire accessory 300 to the semi-automatic firearm. The trigger guard mount 310, which includes a trigger actuator 320, is a forward portion of the rapid-fire accessory 300. The trigger actuator 320 is the portion of the rapid-fire accessory 300 that engages the trigger for discharging the semi-automatic firearms. The trigger guard mount 310 includes a mounting channel 330 (see, FIG. 8E) configured to receive a trigger guard adapter 350. The mounting channel 330 may be sized to allow the trigger guard adapter 350 to slide in a forward and backward direction while resisting movements up, down, and/or laterally.

Figure 13A:
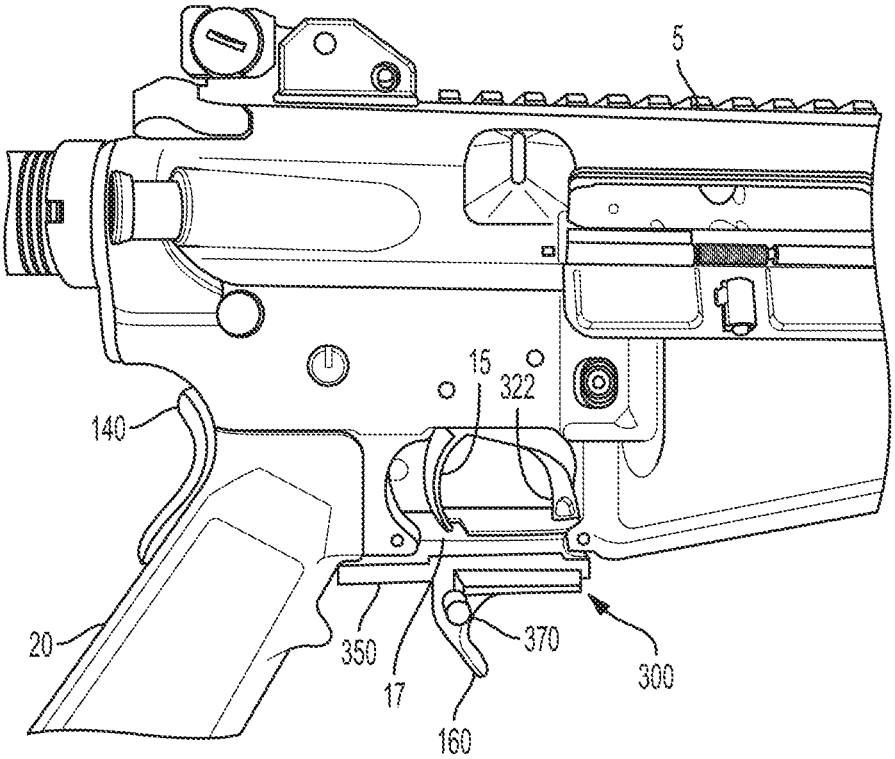
FIG. 13A illustrates a left side view of a rapid-fire accessory on a semi-automatic firearm in a ready-to-fire configuration in accordance with various embodiments.
Figure 14A:
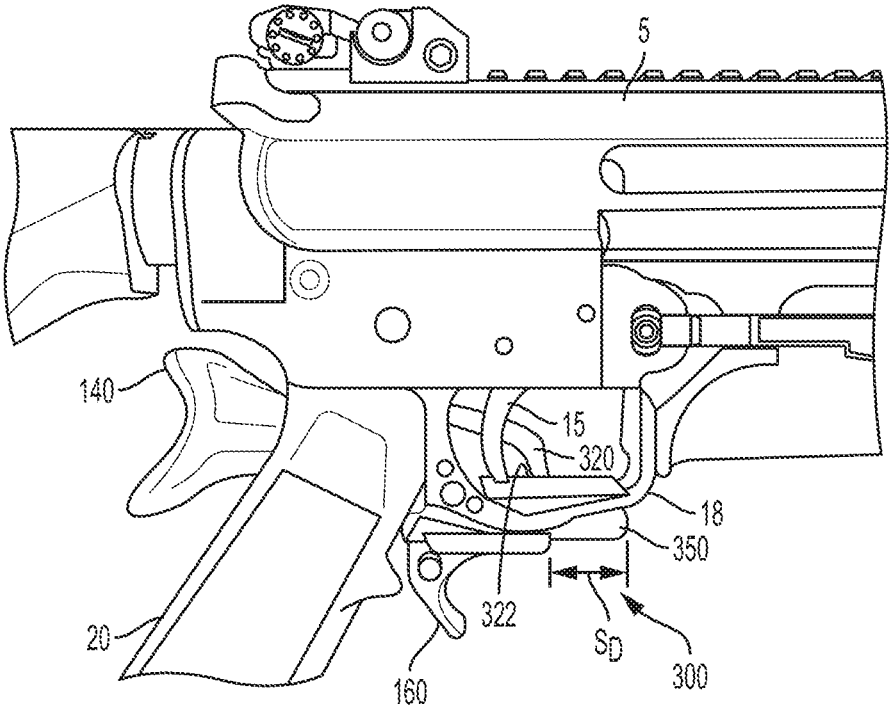
FIG. 14A illustrates a left side view of a rapid-fire accessory on a semi-automatic firearm in a fired configuration in accordance with various embodiments.

Although the trigger guard adapter 350 is configured to move relative to the trigger guard mount 310 (i.e., in the mounting channel 330), the trigger guard adapter 350 is also configured to remain fixed relative to the trigger guard of the semi-automatic firearm (e.g., see trigger guard 17 in FIG. 13A and trigger guard 18 in FIG. 14A). The trigger guard adapter 350 may include an adapter channel 355 (see, in FIG. 8E) configured to receive the trigger guard of the semi-automatic firearm. In addition, the trigger guard adapter 350 may include a receiving aperture 357 (see, FIGS. 9 and 11A) on a lateral side of the trigger guard adapter 350 for inserting the trigger guard into the adapter channel 355. In addition, the trigger guard mount 310 may include an access aperture 317 on the same lateral side of the trigger guard adapter 350 as the receiving aperture 357. The access aperture 317 may allow the trigger guard of the semi-automatic weapon to be inserted into the adapter channel 355 through the receiving aperture 357 while the trigger guard adapter 350 is already mounted within the mounting channel 330. When the trigger guard adapter 350 is mounted on the trigger guard and mounted in the mounting channel 330, the trigger guard adapter 350 guides a sliding movement of the trigger guard mount 310 forward and rearward relative to the trigger guard adapter 350 and the trigger guard.

In various embodiments, the rapid-fire accessory 300 may also include a safety pin 370. The safety pin 370 is a security/safety feature configured to prevent the trigger guard adapter 350 from sliding relative to the trigger guard mount 310. With the safety pin 370 in a locked position (see, FIG. 8E), the trigger guard mount 310 and the trigger guard adapter 350 are fixed relative to one another, which means the trigger actuator 320 is prevented from engaging the trigger (e.g., 15). In this way, the safety pin 370 may prevent the semi-automatic firearm from discharging. Optionally, the rapid-fire accessory 300 need not include the safety pin 370.

Figure 9:
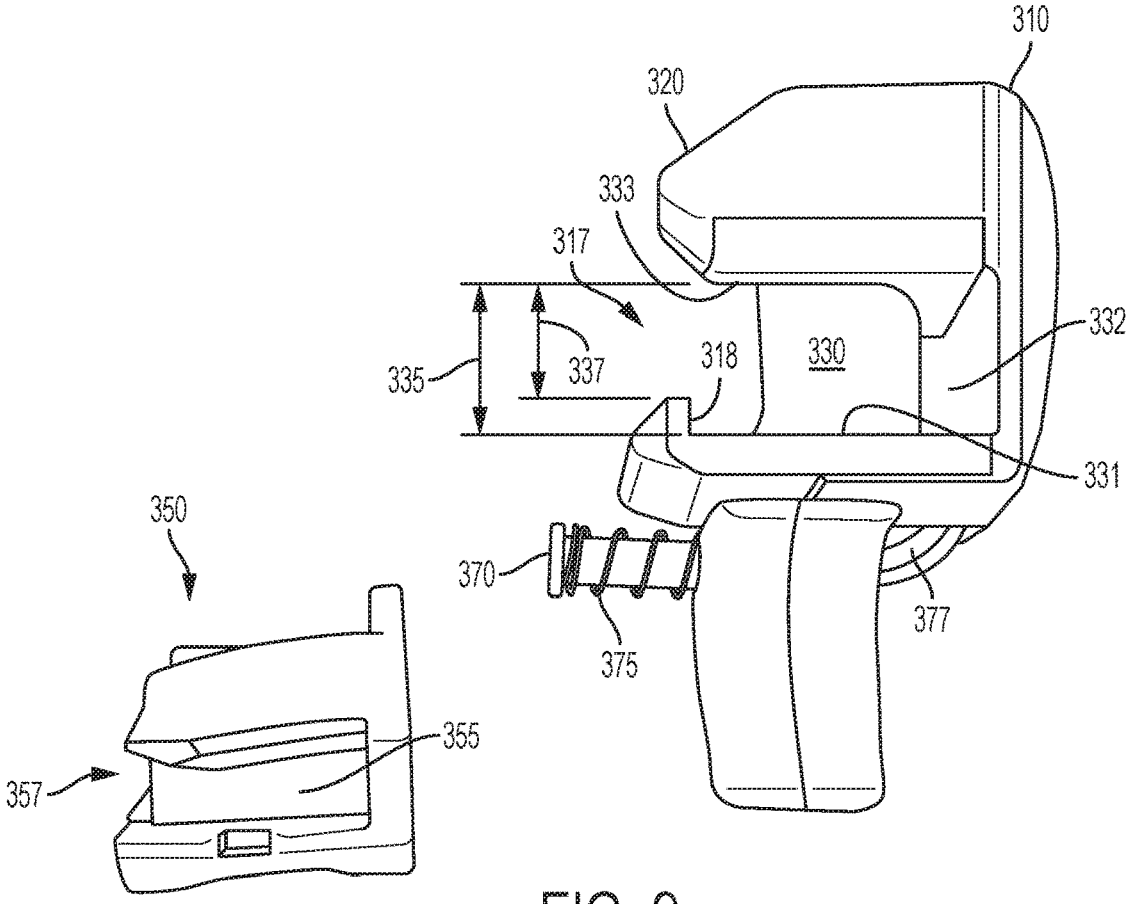
FIG. 9 illustrates a disassembled front view of the rapid-fire accessory of FIGS. 8A-8E in accordance with various embodiments.

FIG. 9 illustrates the trigger guard adapter 350 removed from the mounting channel 330 and separated from the trigger guard mount 310. Further details of the mounting channel 330 are visible with the trigger guard adapter 350 removed there from. In particular, the mounting channel 330 may be formed with a lower wall 331, and upper wall 333 opposed to the lower wall 331, and a lateral wall 332 connecting the lower wall 331 and the upper wall 333. In addition, the lateral wall 332 is opposite the access aperture 317. The access aperture 317 includes a vertical detent 318, which prevents the trigger guard adapter 350 from coming out of the mounting channel 330. In this way, the access aperture 317 has a smaller height 337 than a larger height 335 of the mounting channel 330.

Figure 10A:
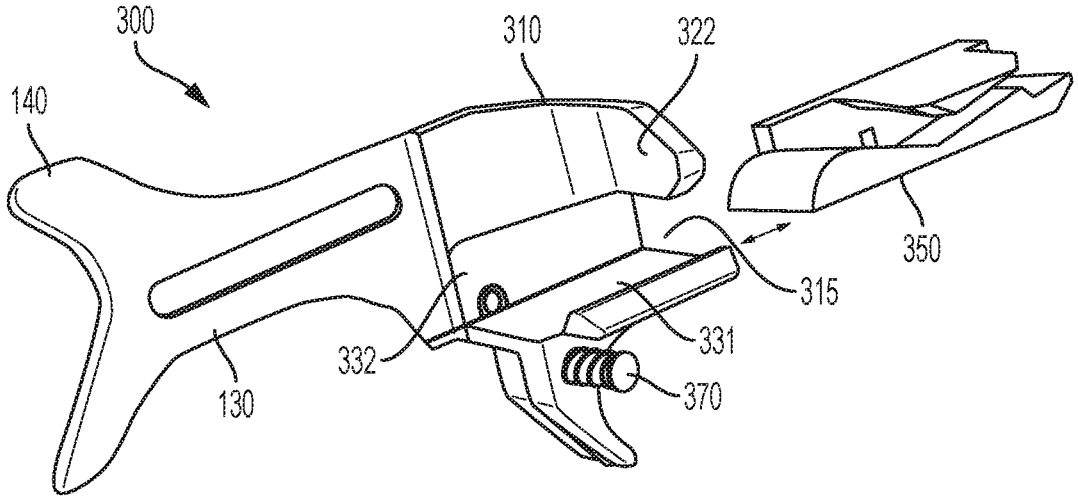
FIG. 10A illustrates an exploded rear-right side downward-looking perspective view of the rapid-fire accessory of FIGS. 8A-9 in accordance with various embodiments.
Figure 10B:
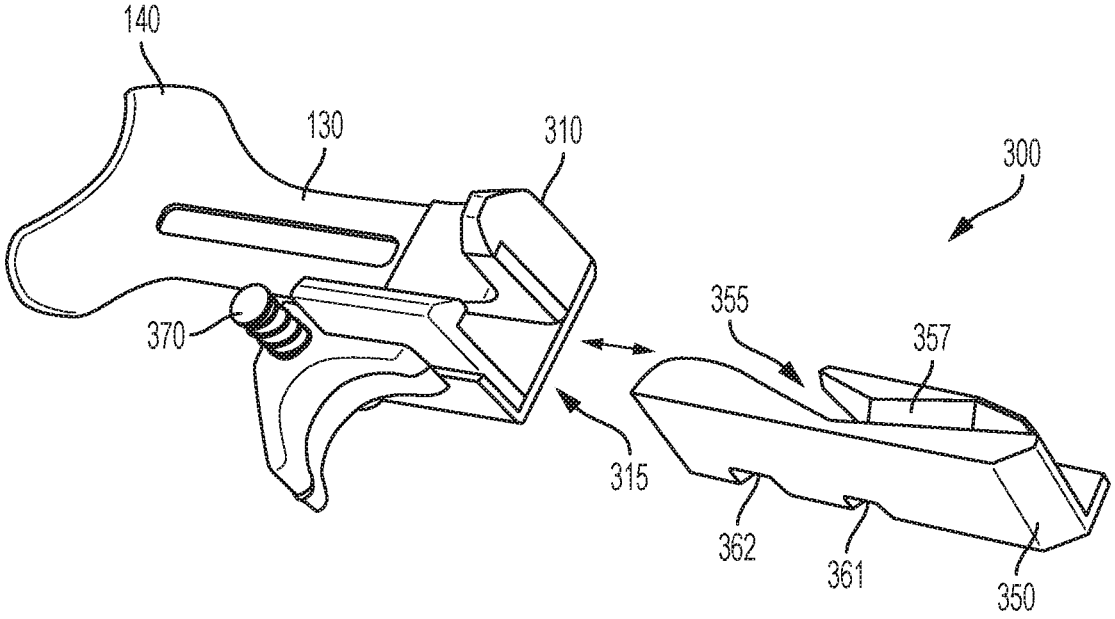
FIG. 10B illustrates an exploded forward-left side downward-looking perspective view of the rapid-fire accessory of FIGS. 8A-10A in accordance with various embodiments.

FIGS. 10A and 10B illustrate exploded views of the rapid-fire accessory 300, with the trigger guard adapter 350 separated. The trigger guard adapter 350 may be separated from the trigger guard mount 310 by sliding the trigger guard adapter 350 forward through the fore-aperture 315 of the trigger guard mount 310. Similarly, the trigger guard adapter 350 may be re-inserted into the mounting channel 330 via fore-aperture 315. Thus, once inserted in the mounting channel 330, a bottom of the trigger guard adapter 350 will slide on the lower wall 331, which supports the trigger guard adapter 350.

Figure 11A:
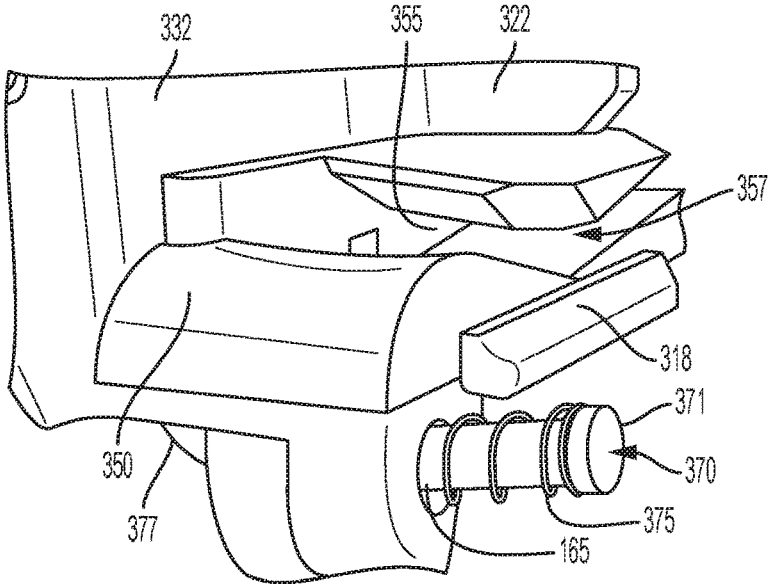
FIG. 11A illustrates a close-up rear-right side downward-looking perspective view of the rapid-fire accessory of FIGS. 8A-10B in accordance with various embodiments.
Figure 11B:
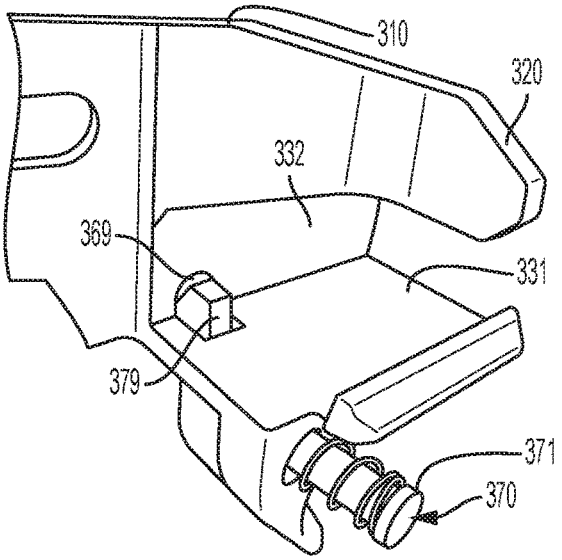
FIG. 11B illustrates the rapid-fire accessory of FIG. 11A, with the trigger guard adapter removed, in accordance with various embodiments.
Figure 11C:
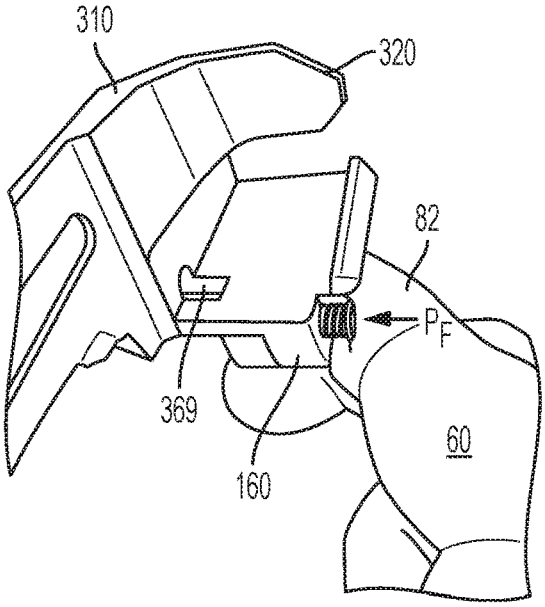
FIG. 11C illustrates the rapid-fire accessory of FIG. 11B, with the trigger guard adapter removed and a user pressing a finger against the safety pin, in accordance with various embodiments.

FIGS. 11A-11C illustrate various aspects of how the safety pin 370 works in relation to the trigger guard mount 310 and the trigger guard adapter 350. In particular, the safety pin 370 may include a head 371, a bend 377, a central elongate portion (i.e., between the head 371 and the bend 377), and an end 379. The end 379 of the safety pin 370 may protrude far enough into the mounting channel 330 to be received in a locking recess (see, locking recesses 361, 362 in FIG. 10B or locking recess 362 in FIG. 12B) of the trigger guard adapter 350. With the end 379 disposed in a locking recess, the safety pin 370 prevents relative movement between the trigger guard adapter 350 and the mounting channel 330. When the end 379 protrudes far enough into the mounting channel 330 to engage the trigger guard adapter 350, the safety pin 370 is referred to herein as being in a "locking position" (as illustrated in FIGS. 11A and 11B).

The safety pin 370 may be a J-shaped structure, with a head 371 of the safety pin 370 (corresponding to the top of the J) disposed on one side of the rapid-fire accessory 300 and the end 379 of the safety pin 370 disposed closer to the other side of the rapid-fire accessory 300. An upper portion of the lower finger grip 160, or a structure below the mounting channel 330, may include a transverse passage 165 that holds the safety pin 370. In this way, a central portion of the safety pin 370 extends from the head 371 through the transverse passage 165, a hooked portion 377 of the safety pin 370 bends 180 degrees upward and back toward the head 371, terminating in the end 379. A portion of the lateral wall 332 may include a safety pin aperture 369, from which the end 379 of the safety pin 370 may protrude into the mounting channel 330.

The safety pin may be biased to stay in the locking position. For example, a spring 375 may be disposed between an outer edge of the transverse passage 165 and the head 371 of the safety pin 370. When an operator 60 pushes the head 371 of the safety pin 370 toward the transverse passage 165, the end 379 of the safety pin 370 is also moved laterally. In this way, when the safety pin 370 is fully depressed, the end 379 of the safety pin 370 is moved out of the mounting channel 330 or at least out of either locking recess (see, locking recesses 361, 362 in FIG. 10B) of the trigger guard adapter 350. When the end 379 does not protrude far enough into the mounting channel 330 to engage the trigger guard adapter 350, the safety pin 370 is referred to herein as being in an "unlocking position" (as illustrated in FIG. 11C).

In accordance with various embodiments, the safety pin 370 is located and works in such a way that the operator 60 will naturally press the safety pin 370 into the unlocking position while holding the rapid-fire accessory 300 during a bump-firing sequence. For example, the operator 60 may wrap a thumb around the thumb grip (e.g., 140) and place the trigger-hand middle finger or trigger finger 82 on the lower finger grip 160. Placing a finger on the lower finger grip 160 in this way will naturally apply a lateral pushing force $P_v$ on the safety pin 370. Once the operator 60 lets go of the rapid-fire accessory 300, the safety pin 370 will automatically return to the locking position.

Alternatively, the safety pin 370 and related structures (e.g., the transverse passage 165 and the safety pin aperture 369) may be incorporated into either of the rapid-fire accessories 100, 200 described above. In such an alternative arrangement, the end 379 of the safety pin 370 may lock with a portion of the trigger guard in such a way that prevents the forward and back sliding motion used to bump fire.

Figure 12A:
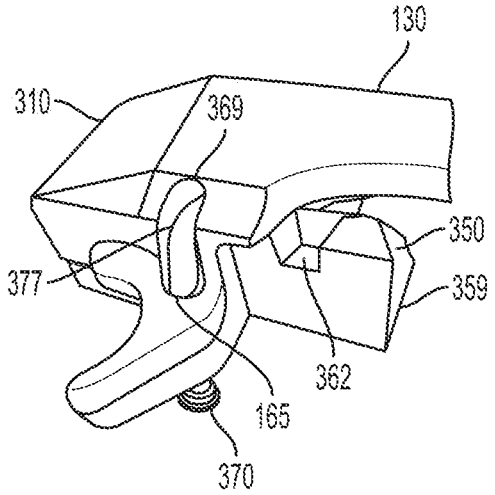
FIG. 12A illustrates a close-up right side upward-looking perspective view of the rapid-fire accessory of FIGS. 8A-11 in a first locked position, in accordance with various embodiments.
Figure 12B:
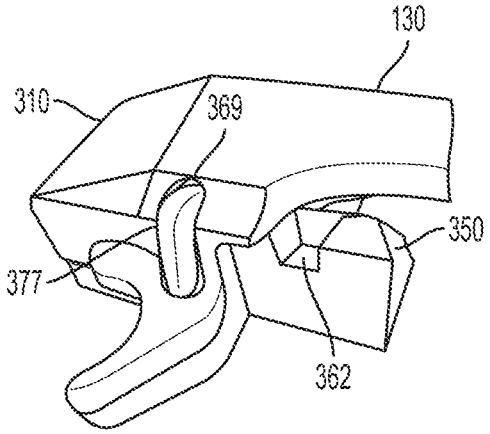
FIG. 12B illustrates a close-up right side upward-looking perspective view of the rapid-fire accessory of FIG. 12A in an unlocked position, in accordance with various embodiments.
Figure 12C:
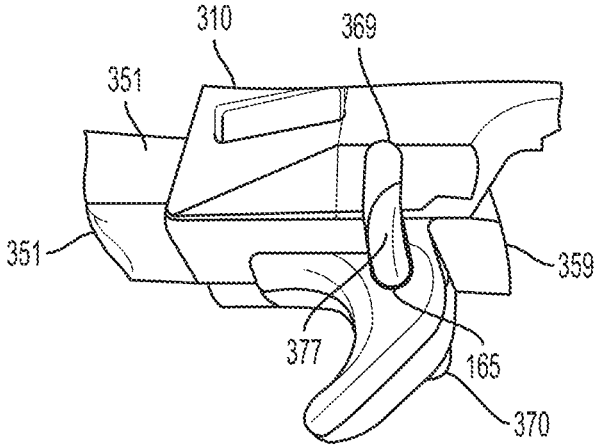
FIG. 12C illustrates a close-up right side upward-looking perspective view of the rapid-fire accessory of FIGS. 12A and 12B in a second locked position, in accordance with various embodiments.

FIGS. 12A-12C illustrate further aspects of how the safety pin 370 works in relation to the trigger guard mount 310 and the trigger guard adapter 350. In particular, the bend 377 of the safety pin 370 is shown protruding from the transverse passage 165 into the safety pin aperture 369. In FIG. 12A, the safety pin 370 is in a first locked position relative to the trigger guard adapter 350, which corresponds to the end (e.g., 379 in FIG. 11B) of the safety pin 370 being disposed in the first locking recess (e.g., locking recess 361 in FIG. 10B). In the first locked position, a rear edge 359 of the trigger guard adapter 350 protrudes from the back end of the trigger guard mount 310 and a fore-edge (see, 351 in FIG. 12C) of the trigger guard adapter 350 is not visible. In FIG. 12B, the safety pin 370 is in an unlocked position, which corresponds to the end (e.g., 379 in FIG. 11B) of the safety pin 370 not being disposed in a locking recess (e.g., locking recesses 361, 362 in FIGS. 10B and 12B). In FIG. 12B, in contrast to FIGS. 12A and 12B, the bend 377 is protruding from the safety pin aperture 369. In the unlocked position, the trigger guard adapter 350 is free to slide forward or backward relative to the trigger guard mount 310. In FIG. 12C, the safety pin 370 is in a second locked position, which corresponds to the end (e.g., 379 in FIG. 11B) of the safety pin 370 being disposed in the second locking recess (e.g., locking recess 362 in FIGS. 10B and 12B). In the second locked position, a fore-edge 351 of the trigger guard adapter 350 protrudes forward beyond the front of the trigger guard mount 310.

Figure 13B:
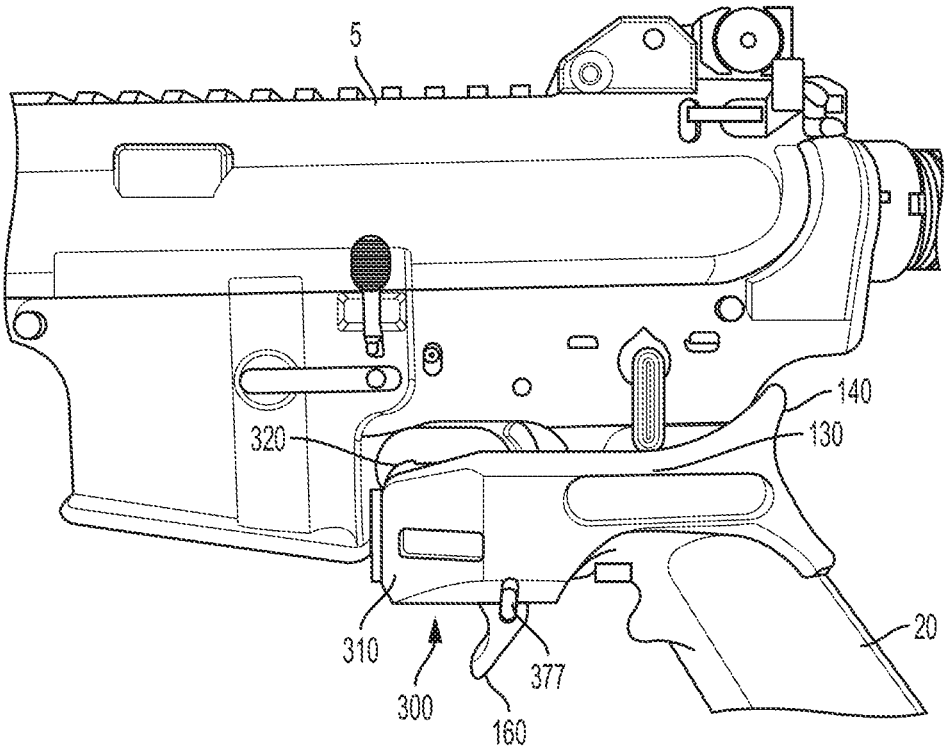
FIG. 13B illustrates a right side view of a rapid-fire accessory on a semi-automatic firearm in a ready-to-fire configuration in accordance with various embodiments.

FIGS. 13A-13B illustrate left and right side close-up views of the semi-automatic firearm 5 in the loaded configuration, using the rapid-fire accessory 300, in accordance with various embodiments. In the loaded configuration, the thumb grip 140 may be close to the pistol grip 20. Also, a fore-end of the trigger guard mount 310 may be close to the forward-most portions of the trigger guard 17 of the semi-automatic firearms 5. In addition, an engagement surface 322 of the trigger actuator 320 is spaced away from the trigger 15.

Figure 14B:
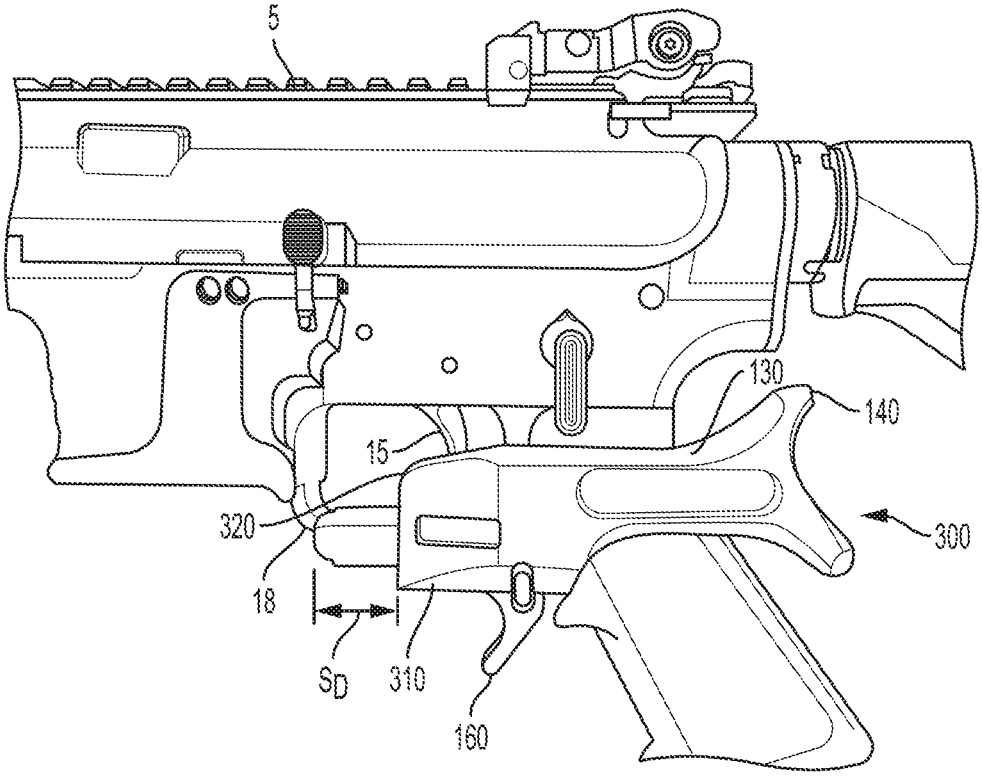
FIG. 14B illustrates a right side view of a rapid-fire accessory on a semi-automatic firearm in a fired configuration in accordance with various embodiments.

FIGS. 14A-14B illustrate left and right side close-up views of the semi-automatic firearm 5 in the fired configuration, using the rapid-fire accessory 300, in accordance with various embodiments. In the fired configuration, the thumb grip 140 is now spaced away from the pistol grip 20, while the trigger actuator 320 is now engaged with and has pulled the trigger 15. In moving from the loaded configuration to be fired configuration, the engagement surface 322 may contact with an pulled the trigger 15, thus discharging a semi-automatic firearm 5. Also, since the trigger guard adapter 350 is configured to remain fixed relative to the trigger guard 18, a fore-edge of the trigger actuator 320 is now spaced a distance $S_D$ relative to the trigger guard adapter 350.

For illustrative purposes, the trigger guard 17 in FIG. 13A is a relatively flat trigger guard. In this way, the adapter channel of the trigger guard adapter 350 may have a continuous rectangular shape that conforms to such a trigger guard 17. In contrast, the trigger guard 18 in FIG. 14A has a shallow bend, which is more suitable for the adapter channel 355 in FIGS. 8A-11A.

An operator may secure the rapid-fire accessory 300 to the semi-automatic firearm 5 by snapping the trigger guard mount 310, with the trigger guard adapter 350 already install therein, onto the trigger guard (e.g., 17, 18) from a lateral side of the semi-automatic firearm 5. In this way, mounting the rapid-fire accessory 300 is similar to mounting the rapid-fire accessory 100. Similarly, the rapid-fire accessory 300 may be removed from the same side it was installed.

The foregoing descriptions are provided merely as illustrative examples and are not intended to require or imply that the elements of various embodiments are required. Further, any reference to claim elements in the singular, for example, using the articles "a," "an" or "the" is not to be construed as limiting the element to the singular.

While the terms such as "first" and "second" are used herein to describe similarly named elements, such identifiers are merely for convenience and are not meant to limit various embodiments to a particular order, sequence, type of network or carrier.

The rapid-fire accessory in accordance with various embodiments provides an easy-to-use device that may enable an operator to bump fire a semi-automatic firearm more easily than free hand techniques. In addition, the rapid-fire accessory in accordance with various embodiments does not demand significant modification of the semi-automatic firearm, such as replacement of the pistol grip, stock, and/or other elements. In this way, users may keep their favorite original, replacement, or aftermarket stock and/or pistol grip. The rapid-fire accessory in accordance with various embodiments is also quick and easy to install without requiring special tools. Further, the rapid-fire accessory in accordance with various embodiments is not bulky, is relative small, and may be manufactured relatively inexpensively.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. A rapid-fire accessory for a semi-automatic firearm, comprising:

a trigger guard mount for attaching the rapid-fire accessory to the semi-automatic firearm, wherein the trigger guard mount includes a mounting channel for receiving a trigger guard of the semi-automatic firearm;

a trigger actuator for engaging a trigger of the semi-automatic firearm, wherein the trigger actuator is fixed relative to the mounting channel and configured to pull the trigger when the trigger guard slides forward in the mounting channel; and a trigger guard adapter configured to mount on and remain fixed relative to the trigger guard of the semi-automatic firearm, wherein the trigger guard adapter includes an adapter channel for receiving therein the trigger guard of the semi-automatic firearm, wherein when the trigger guard adapter is mounted on the trigger guard and mounted in the mounting channel, the trigger guard adapter guides a sliding movement of the trigger guard mount forward and rearward relative to the trigger guard adapter and the trigger guard, wherein the adapter channel is formed by an upper wall, a lower wall opposed to the upper wall, and a lateral wall connecting the lower wall and the upper wall, wherein the trigger guard engages at least one of the lower wall and the upper wall during the sliding movement.

2. The rapid-fire accessory of claim 1, wherein when the trigger guard is mounted in the adapter channel, the upper wall is disposed between the trigger and the trigger guard.

3. The rapid-fire accessory of claim 1, wherein the adapter channel includes a receiving aperture for inserting the trigger guard in the adapter channel, wherein flexing a portion of the trigger guard adapter increases a width of the receiving aperture for releasing the trigger guard from the adapter channel.

4. A rapid-fire accessory for a semi-automatic firearm, comprising:

a trigger guard mount for attaching the rapid-fire accessory to the semi-automatic firearm, wherein the trigger guard mount includes a mounting channel for receiving a trigger guard of the semi-automatic firearm;

a trigger actuator for engaging a trigger of the semi-automatic firearm, wherein the trigger actuator is fixed relative to the mounting channel and configured to pull the trigger when the trigger guard slides forward in the mounting channel; and a trigger guard adapter configured to mount on and remain fixed relative to the trigger guard of the semi-automatic firearm, wherein the trigger guard adapter includes an adapter channel for receiving therein the trigger guard of the semi-automatic firearm, wherein when the trigger guard adapter is mounted on the trigger guard and mounted in the mounting channel, the trigger guard adapter guides a sliding movement of the trigger guard mount forward and rearward relative to the trigger guard adapter and the trigger guard, wherein the trigger guard adapter includes a receiving aperture on a lateral side of the trigger guard adapter for inserting the trigger guard into the adapter channel.

5. The rapid-fire accessory of claim 4, wherein a detent protrudes across a portion of the receiving aperture for trapping the trigger guard in the adapter channel.

* * * * *